US007556516B2

(12) United States Patent
Osada et al.

(10) Patent No.: US 7,556,516 B2
(45) Date of Patent: Jul. 7, 2009

(54) CONNECTOR AND ELECTRICAL CONNECTION DEVICE

(75) Inventors: Tsuyoshi Osada, Yokohama (JP); Takamasa Yagi, Miyoshi-cho (JP)

(73) Assignee: J.S.T. Mfg. Co., Ltd., Osaka-shi (JP)

( * ) Notice: Subject to any disclaimer, the term of this patent is extended or adjusted under 35 U.S.C. 154(b) by 0 days.

(21) Appl. No.: 12/116,482

(22) Filed: May 7, 2008

(65) Prior Publication Data

US 2008/0293275 A1 Nov. 27, 2008

(30) Foreign Application Priority Data

May 21, 2007 (JP) ..... 2007-133784

(51) Int. Cl.
*H01R 29/00* (2006.01)

(52) U.S. Cl. ..... 439/188

(58) Field of Classification Search ..... 439/188, 439/352, 353, 357

See application file for complete search history.

(56) References Cited

U.S. PATENT DOCUMENTS 5,275,575 A 1/1994 Cahaly et al.
6,786,746 B2 * 9/2004 Nagamine et al. ..... 439/188
6,837,725 B1 * 1/2005 Gordon et al. ..... 439/188
6,939,152 B1 * 9/2005 Chen ..... 439/188
2006/0128195 A1 * 6/2006 Chen ..... 439/188

FOREIGN PATENT DOCUMENTS

JP 2002-324638 11/2002
JP 3650034 2/2005

* cited by examiner

*Primary Examiner*—Phuong K Dinh
(74) *Attorney, Agent, or Firm*—Oblon, Spivak, McClelland, Maier & Neustadt, P.C.

(57) ABSTRACT

A connector 8 includes a plug element 3, a short-circuiting element 4, and a latching element 50 to be latched at a first latching position and a second latching position. When the latching element 50 is at the second latching position, a short-circuiting piece **4*m* moves to a non-short-circuit position. The latching element 50 has latch portions 52 formed in a projecting manner, and the short-circuiting element 4 has latch receiving portions 41*a*. In a state where the plug element 3 is inserted into the socket element 2*i*, when the latching element 50 is at the second latching position, the latch portions 52 and the latch receiving portions 41*a* engage with each other to prevent separation between the socket element 2*i* and the plug element 3**.

12 Claims, 18 Drawing Sheets

(b)

(a)

First lock temporarily completed state
(Second lock operation starting state)

Insertion completed state
(First and second lock completed state)

CONNECTOR AND ELECTRICAL CONNECTION DEVICE

BACKGROUND OF THE INVENTION

1. Field of the Invention

The present invention relates to a technical field of an electrical connection device, and specifically, to a connector and an electrical connection device including a latching element provided in a plug element, constructed so that, when a socket element and the plug element are not properly connected, electric contacts of the socket element are short-circuited by each other, and when these elements are properly connected, the short-circuited state between the electric contacts is removed.

The present invention is suitable especially to be for being applied to an airbag system. Hereinafter, application to the airbag system will be described mainly, however, the present invention is also applicable to a wide variety of uses and environments.

2. Description of Related Art

An airbag system includes an airbag assembly attached to a section that cannot be observed from the outside of a driver's cabin of a vehicle and an electric or electronic control system, and these control system and airbag assembly are connected via a wire harness (general term of cable processed products). Herein, the airbag assembly includes a squib (airbag igniter) for igniting an airbag. Then, to realize an easy electrical connection between the control system and the airbag assembly which are attached separately to predetermined positions, the wire harness is provided with a connection device. As this connection device, for example, connection devices described in Japanese Published Unexamined Patent Application No. 2002-324638 (Document 1), Japanese Patent No. 3650034 (Document 2), and U.S. Pat. No. 5,275,575 (Document 3) are known. These connection devices include a plug element (second component) to be inserted into a socket element (first component). The socket element is a housing, etc., of an inflator, and has a concave portion (socket) into which the plug element is inserted.

The connection device includes a short-circuiting element, and this short-circuiting element is provided with a short-circuiting piece. This short-circuiting piece is a metal member arranged so as to electrically short-circuit two leads with each other before the plug element and the socket element engage with each other. Such a short-circuiting piece is provided as a safety means for preventing erroneous operation of the airbag assembly due to a charge leak and erroneous connection during manufacturing of the airbag assembly.

When the connection device is completely properly connected, the short-circuiting piece as a safety means is moved to a non-short-circuit position. In Document 1 and Document 2, a connection device including, as a mechanism for releasing this safety device, a latching element movable between a first latching position and a second latching position is disclosed.

These connection devices are structured so that, until both components (plug element and socket element) completely engage with each other and the latching element moves to the final latching position (second latching position), electrical connection is not completed. The latching element has a function of preventing erroneous disconnection of these components after the components are integrated in the connection device. The latching element is provided with a pushed portion (ceiling portion) to be pushed. The connection state of the connection device can be easily confirmed by confirming a rising height of the pushed portion with respect to the plug element main body.

In the connection device described in Document 3, a two-stage operation is necessary to push the latching element in, however, in the connection devices of Document 1 and Document 2, the latching element can be pushed in by a one-stage operation.

SUMMARY OF THE INVENTION

In the technique of Document 1 and Document 2, the plug element and the socket element are prevented from separating from each other by engaging the latching element and the socket element (for example, see FIG. 10 of Document 1 and FIG. 13 of Document 2). In detail, on the latching element, a latch portion is formed in a projecting manner, and a latching concave portion is formed continuously in the circumferential direction inside the socket of the socket element. The latch portion enters the latching concave portion to maintain the engagement between the plug element and the socket element, and electrical and mechanical connection between the plug element and the socket element is completed. In other words, in a connection completed state, the latching element and the socket element directly engage with each other.

However, in this construction, (i) the rising height of the latching element with respect to the plug element main body when the latching element is at the first latching position (temporary latching position), (ii) the engagement of the latching element when the connection of the connection device is completed, and (iii) timings of short-circuit removal and connection completion in the series of connecting operations, etc., depend on the size of the socket opening and the shape of the latching concave portion. Therefore, the latching element must be designed according to the shape of the socket element. In addition, the shape of the socket element differs depending on its type, so that the latching element must be designed and manufactured for each socket element type to realize reliable connection of the connection device, and this is troublesome. On the other hand, when the latching element is not designed for each socket element type but is designed by assuming an average shape of the socket element, depending on the socket element type, reliable connection may not be made.

Therefore, an object of the present invention is to provide a connector and an electrical connection device which can realize an easy and reliable connection without depending on the shape of the socket element.

To achieve the object, a connector of the present invention is connectable to a socket element supporting a pair of fitting elements, including: a plug element which supports a pair of fitted elements to be electrically connected to the pair of fitting elements, and is inserted into and engages with the socket element; a short-circuiting element which includes a short-circuiting piece for electrically short-circuiting the pair of fitting elements, and is attached to the socket element; and a latching element which is latched on the plug element at a first latching position and a second latching position. The latching element is movable between the first latching position and the second latching position, and in a state where the plug element is inserted into the socket element, when the latching element is at the second latching position, the short-circuiting piece moves to the non-short-circuit position, and either the latching element or the short-circuiting element has a latch portion formed in a projecting manner, and the other of these has a latch receiving portion formed so as to engage with the latch portion, and in the state where the plug element is inserted into the socket element, when the latching element is at the second latching position, the latch portion and the latch receiving portion engage with each other.

According to this construction, when the latching element moves to the second latching position, the short-circuited state of the fitting elements is removed, and the latching element is attached to the short-circuiting element. In addition, the plug element and the socket element directly engage with each other. Therefore, in the connector having the latching element, the shape of the latching element is determined depending on only the shapes of the plug element and the short-circuiting element without depending on the shape of the socket element. Accordingly, (i) the rising height of the latching element with respect to the plug element main body when the latching element is at the first latching position (temporary latching position), (ii) the engagement of the latching element when the connection of the electrical connection device is completed, and (iii) timings of short-circuit removal and connection completion in the series of connecting operations, etc., can be designed without depending on the shape of the socket element. Therefore, in comparison with the case where the latching element is designed and manufactured for each socket element type, the design and manufacturing of the latching element become easy, and reliable connection can be made without depending on the socket element type. As described above, with this construction, an easy and reliable connection can be made without depending on the shape of the socket element.

A connector of the present invention is connectable to a socket element supporting a pair of fitting elements, including: a plug element which supports a pair of fitted elements to be electrically connected to the pair of fitting elements, and is inserted into the socket element and engages with the socket element; a short-circuiting element which includes a short-circuiting piece for electrically short-circuiting the pair of fitting elements, and is attached to the socket element; and a latching element to be latched on the plug element at a first latching position and a second latching position. The latching element is movable between the first latching position and the second latching position, and in the state where the plug element is inserted into the socket element, when the latching element is at the second latching position, the short-circuiting piece moves to a non-short-circuit position, and the latching element has two latch portions formed in a projecting manner, the short-circuiting element has two latch receiving portions formed so as to engage with the two latch portions, and in the state where the plug element is inserted into the socket element, when the latching element is at the second latching position, the two latch portions and the two latch receiving portions engage with each other, and the latching element includes a plate-like pushed portion to be pushed, a pair of first legs formed so as to project from the pushed portion, and a second leg formed so as to project from the pushed portion, each of the pair of first legs has the latch portion, the second leg moves the short-circuiting piece to the non-short-circuit position by contact with the short-circuiting piece when it is at the second latching position in the state where the plug element is inserted into the socket element, and the pair of first legs are arranged so that the two latch portions are opposed to each other. Accordingly, the latching element which works so as to (i) mechanically and electrically connect both components and (ii) remove a short circuit of the short-circuiting element can be formed with a simple construction.

In the connector of the present invention, it is also allowed that the two latch portions of the pair of first legs are formed so as to project to each other, the plug element has a pair of terminal protectors formed into cylindrical shapes surrounding the peripheries of the pair of fitted elements, the short-circuiting element has a pair of outer peripheral walls formed into cylindrical shapes into which the pair of terminal protectors are inserted and which surround the peripheries of the pair of fitting elements, and the two latch receiving portions are provided on the pair of outer peripheral walls. According to this construction, the latching element which works so as to (i) mechanically and electrically connect both components and (ii) remove a short circuit of the short-circuiting element can be formed with a simple construction. In addition, deformation of the fitting elements can be prevented. Therefore, the terminal protectors and outer peripheral walls for preventing deformation of the fitting elements and portions where the latch receiving portions are formed do not have to be provided on separate members, so that the construction of the electrical connection device can be made simple. The operation for connecting both components and the operation for pushing the latching element in for removing a short circuit can be performed by a series of operations at one time.

In the connector of the present invention, it is also allowed that the short-circuiting element has a pair of walls provided along the inserting direction of the plug element into the socket element, and on each of the pair of walls, an end portion of the wall and the latch receiving portion are arranged along the inserting direction in order from the side of the plug element, and in the state where the plug element is inserted into the socket element, when the latching element at the first latching position is pushed, by contact between each of the pair of first legs and the end portions, the pair of first legs elastically bend to release latching at the first latching position, and the latching element becomes movable to the second latching position. Accordingly, by the simple device construction, latching can be easily released. In addition, the operation for connecting both components and the operation for pushing the latching element in for removing a short circuit can be performed by a series of operations at one time.

In the connector of the present invention, it is also allowed that the plug element has a pair of terminal protectors formed into cylindrical shapes surrounding the peripheries of the pair of fitted elements, the short-circuiting element has a pair of outer peripheral walls formed into cylindrical shapes into which the pair of terminal protectors are inserted and which surround the peripheries of the pair of fitting elements, and on each of the pair of outer peripheral walls, an end portion of the outer peripheral wall and the latch receiving portion are arranged along the inserting direction in order from the side of the plug element, and in the state where the plug element is inserted into the socket element, when the latching element at the first latching position is pushed, by contact between each of the tip ends of the pair of first legs and each of the end portions of the pair of outer peripheral walls, the pair of first legs elastically bend to the radially outer sides of the outer peripheral walls to release latching at the first latching position, and the latching element becomes movable to the second latching position. Accordingly, deformation of the fitting elements can be prevented, and the latching can be easily released by a simple device construction.

In the connector of the present invention, it is also allowed that the pair of first legs project in a direction along the inserting direction of the plug element into the socket element when the latching element is at the first latching position in the state where the plug element is inserted into the socket element. Accordingly, without depending on the shape of the socket element, a device construction which can make an easy and reliable connection can be more simply and more reliably realized. The operation for connecting both components and the operation for pushing the latching element in for removing a short circuit of the short-circuiting piece can be performed by a series of operations at one time.

In the connector of the present invention, it is also allowed that each of the pair of first legs has a latching convex portion formed in a projecting manner, the plug element has a latch receiving convex portion formed in a projecting manner, and on the latching convex portion and the latch receiving convex portion, a contact surface and a contacted surface are formed, and at the first latching position, the contact surface and the contacted surface come into contact with each other, so that the latching element is latched on the plug element. Accordingly, the device construction in which the latching element is latched on the plug element can be simply and reliably realized.

In the connector of the present invention, it is also allowed that the contact surface and the contacted surface come into contact with each other in the inserting direction of the plug element into the socket element when the latching element is at the first latching position. Accordingly, in conjunction with pushing of the latching element, the plug element is reliably inserted into the socket element.

In the connector of the present invention, it is also allowed that the plug element has a pair of terminal protectors formed into cylindrical shapes surrounding the peripheries of the pair of fitted elements, the short-circuiting element has a pair of outer peripheral walls formed into cylindrical shapes into which the pair of terminal protectors are inserted and which surround the peripheries of the pair of fitting elements, and on each of the pair of outer peripheral walls, an end portion of the outer peripheral wall and the latch receiving portion are arranged along the inserting direction in order from the side of the plug element, and in the state where the plug element is inserted into the socket element, when the latching element at the first latching position is pushed, by contact between each of the tip ends of the pair of first legs and each of the end portions of the pair of outer peripheral walls, the pair of first legs elastically bend to the radially outer sides of the outer peripheral walls, and the latching convex portion comes apart from the position of the latch receiving convex portion and the contact surface and the contacted surface are separated from each other, so that the latching at the first latching position is released, and as a result, the latching element becomes movable to the second latching position. Accordingly, deformation of the fitting elements can be prevented, and latching can be easily released by a simple device construction. In addition, a device construction in which the latching element is latched on the plug element can be simply and reliably realized. Further, in conjunction with pushing of the latching element, the plug element is reliably inserted into the socket element. The operation for connecting both components and the operation for pushing the latching element in for removing a short circuit of the short-circuiting piece can be more reliably performed by a series of operations at one time.

In the connector of the present invention, it is also allowed that the latching element has a restricting portion formed so as to project from the pushed portion, and the restricting portion restricts the movement of the plug element so as to prevent the plug element from coming off the socket element when the latching element is at the second latching position in the state where the plug element is inserted into the socket element. Accordingly, the plug element can be prevented from coming off the socket element. Therefore, the latching element reliably prevents the plug element and the socket element from separating.

In the connector of the present invention, in the socket element, an engaging concave portion is formed by recessing the socket element, and the plug element has a pair of terminal protectors formed into cylindrical shapes surrounding the peripheries of the pair of fitted elements and has a support portion formed so as to project from the main body of the plug element, an engaging convex portion which engages with the engaging concave portion is formed on the support portion, and the restricting portion is inserted between the terminal protectors and the support portion and restricts the movement of the engaging convex portion so as to come off the engaging concave portion from the inner side. Accordingly, the plug element and the socket element are prevented from separating from each other by a simple construction.

To achieve the above-described object, an electrical connection device of the present invention includes a socket element which supports a pair of fitting elements and any one of the above-described connectors, where the connector is connected to the socket element. According to this construction, an easy and reliable connection can be made without depending on the shape of the socket element.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, a preferred embodiment of the present invention will be described with reference to the drawings.

(Entire Construction)

Figure 1:
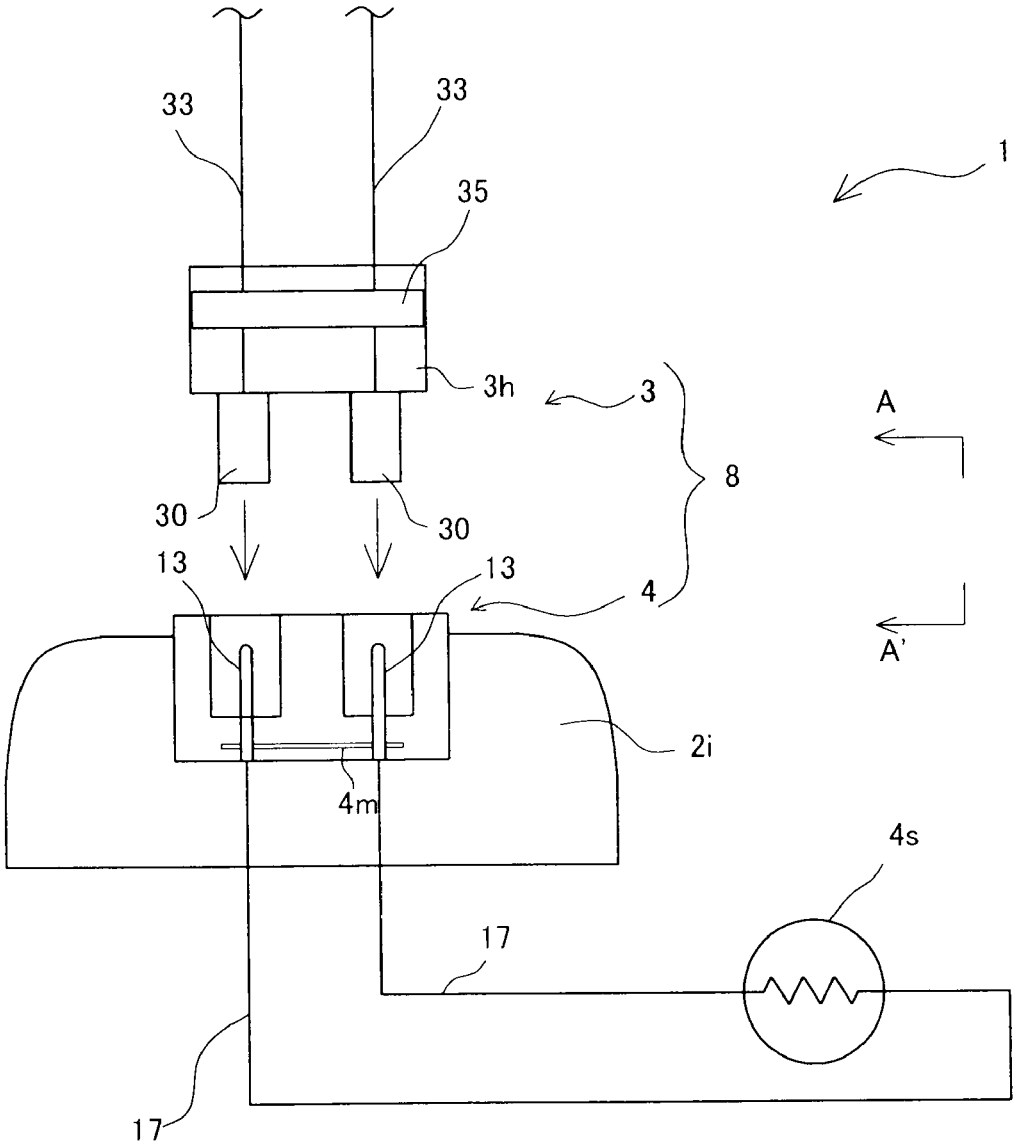
FIG. 1 is a schematic view of a connector and an electrical connection device of an embodiment of the present invention.

First, the entire construction of the electrical connection device of an embodiment of the present invention will be described with reference to FIG. 1. FIG. 1 is a schematic view of the electrical connection device relating to this embodiment.

As shown in FIG. 1, the electrical connection device 1 includes a socket element 2*i* and a connector 8. In this embodiment, the socket element 2*i* is a housing of an airbag inflator, and supports a pair of pins (fitting elements) 13. The connector 8 includes a plug element 3, a short-circuiting element 4, and a latching element 50, and is connected to a socket element 2*i* supporting the pair of pins 13. The plug element 3 supports a pair of female terminals (fitted elements) to be electrically connected to the pair of pins 13, and is inserted into the socket element 2*i* and engages with the socket element 2*i*. The short-circuiting element 4 has a short-circuiting piece 4*m* which electrically short-circuits the pair of pins 13, and is attached to the socket element 2*i*. The latching element 50 is latched on the plug element 3 at two first and second latching positions.

The pair of female terminals 30 provided on the connector 8 of the electrical connection device 1 are connected to two electric wires 33. The pair of pins 13 provided on the socket element 2*i* are connected to two electric wires 17. The two electric wires 17 are connected to a squib (airbag igniter) 4*s*. The squib 4*s* performs an ignition operation when supplied with sufficient electric energy. As shown by the arrow in FIG. 1, by connecting the plug element 3 to the short-circuiting element 4, that is, by electrically connecting the pair of female terminals 30 and the pair of pins 13, a DC circuit which enables heating of the squib 4*s* based on an instruction from an unillustrated airbag control system is formed. By this heating, an unillustrated gas generating material is ignited and generates a gas, and an unillustrated airbag is expanded.

Figure 2:
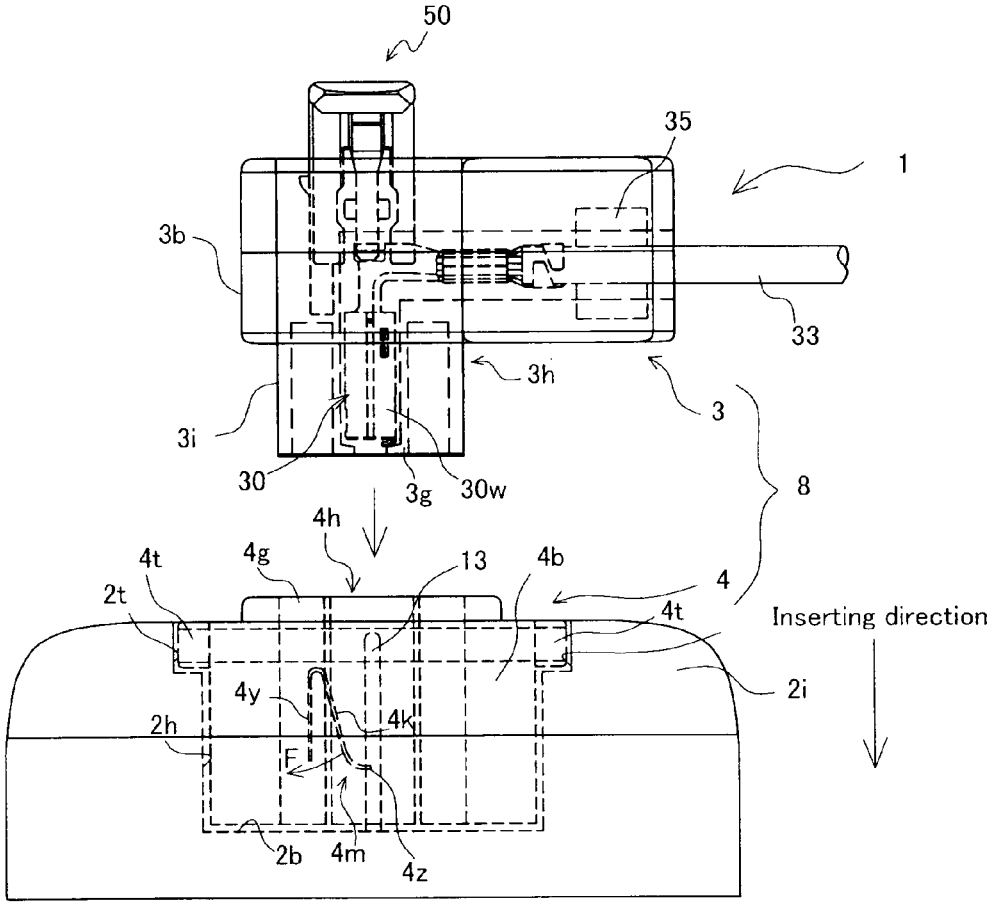
FIG. 2 is a schematic view showing in more detail the construction of the connector and the electrical connection device of FIG. 1.

FIG. 2 is a schematic view showing in detail the construction of the electrical connection device 1. FIG. 2 corresponds to a side view (view along the arrow A-A') of FIG. 1, and only one of the pins 13 and one of the female terminals 30 in pairs in FIG. 1 are shown. FIG. 2 shows a state where the latching element 50 is latched at the first latching position. In FIG. 2, the internal structure that is not exposed to the outer surface is shown by the dashed lines, and the two electric wires 17 and squib 4*s* are not shown. Hereinafter, detailed constructions of the respective parts will be described. In the following description, "inserting direction" means an inserting direction of the plug element 3 into the socket element 2*i* (see the arrow direction in each figure).

(Socket Element)

First, details of the socket element (housing of inflator) 2*i* and the pair of pins 13 will be described with reference to FIG. 2, etc. The socket element 2*i* is formed into a columnar shape whose corners on the upper surface are chamfered, and on the outer surface thereof (upper portion in FIG. 2), has a socket (concave portion) 2*h*. The socket 2*h* is formed as a concave portion in the socket element 2*i*, and opens upward in FIG. 2. In the socket 2*h*, on the upper surface of the socket element 2*i*, two concave portions 2*t* to be used for positioning the short-circuiting element 4 described later are provided so as to project radially outward.

A detailed construction of the socket 2*h* will be described with reference to the sectional view of FIG. 12. On the edge of the opening of the socket 2*h*, an inclined surface 14 continued along the circumferential direction is formed, and on the inner periphery of the socket 2*h* on the more inner side in the inserting direction than the inclined surface 14, an engaging concave portion 15 continued along the circumferential direction is formed. The engaging concave portion 15 is recessed radially outward. As described later, the inclined surface 14 functions to receive support portions 31*a* (more specifically, engaging convex portions 31*b*) formed on the plug element 3, and in conjunction with an inserting operation of the plug element 3, guides it toward the radially inner side with respect to the support portions 31*a*. The engaging concave portion 15 functions so as to maintain the engagement of the connector 8 by receiving the engaging convex portions 31*b* (described later) of the plug element 3.

(Pin)

The pair of pins 13 are electrically connected to the squib 4*s* for igniting the airbag via two electric wires 17 (not shown in FIG. 2), and as described above, arranged so as to rise from the bottom surface 2*b* of the socket 2*h* to the vicinity of the opening edge of the socket element 2*i* at the radially central portion of the socket 2*h*. The pair of pins 13 are thus supported by the socket element 2*i*.

(Connector)

Next, details of the connector 8 will be described. As described above, the connector 8 includes a plug element 3, the short-circuiting element 4, and the latching element 50. Hereinafter, detailed constructions of the plug element 3, the short-circuiting element 4, and the latching element 50 will be described.

(Plug Element)

The plug element 3 has female terminals 30 and a plug housing 3*h*. Hereinafter, the female terminals 30 and the plug housing 3*h* will be described, respectively.

(Female Terminal)

The female terminals 30 will be described with reference to FIG. 2. FIG. 2 shows a state where the pair of electric wires 33 are attached to the pair of female terminals 30. As described above, a pair of female terminals 30 are attached to the plug element 3, and the female terminals 30 have the same shape.

Hereinafter, one female terminal 30 will be described. The female terminal 30 is electrically connected to the pin 13 as described above, and includes an outer peripheral wall 30*w* formed into a cylindrical shape and an unillustrated spring provided inside the outer peripheral wall 30*w*. The female terminal 30 is formed through various processings from one metal plate, and is formed so as to receive the pin 13. The female terminal may be composed of a plurality of parts.

The female terminal 30 is formed into a substantially L shape turned from the cylindrical outer peripheral wall 30*w*, and is connected to the electric wire 33 (see FIG. 2). The electric wire 33 is covered by an insulating covering, and at the end of this covering, an internal conductor is exposed for electrical connection to the female terminal 30. The electric wire 33 is attached to the female terminal 30 by an arbitrary method, for example, by pressure-bonding a part of the female terminal 30 to the periphery of the conductor end portion of the electric wire 33.

The spring is formed inside the outer peripheral wall 30*w*, and comes into contact with the pin 13 at the time of connection to the pin 13. The spring is formed into a long plate along the axial direction of the outer peripheral wall 30*w*.

(Plug Housing)

Figure 3:
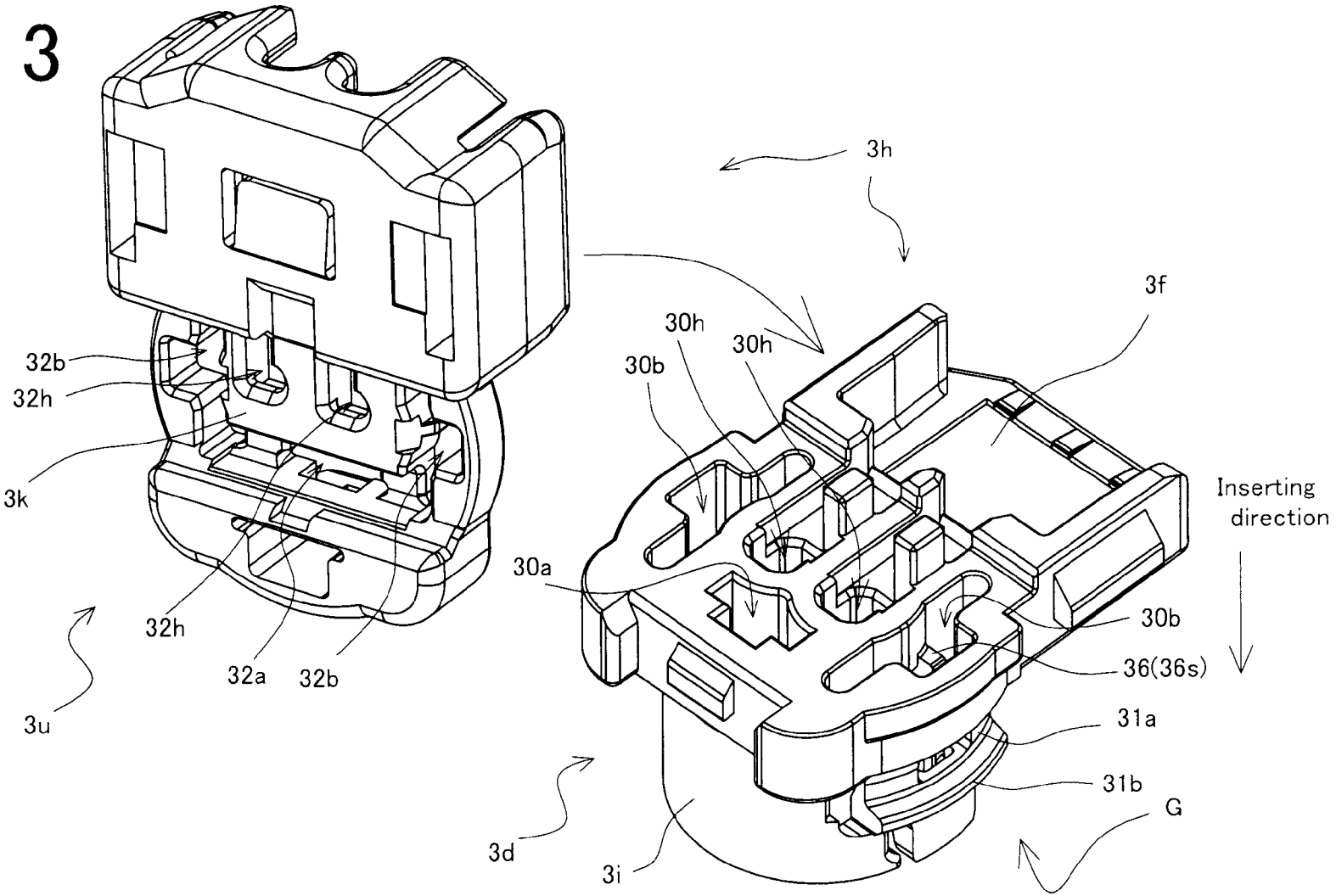
FIG. 3 is an exploded perspective view of a plug housing of FIG. 2.
Figure 4:
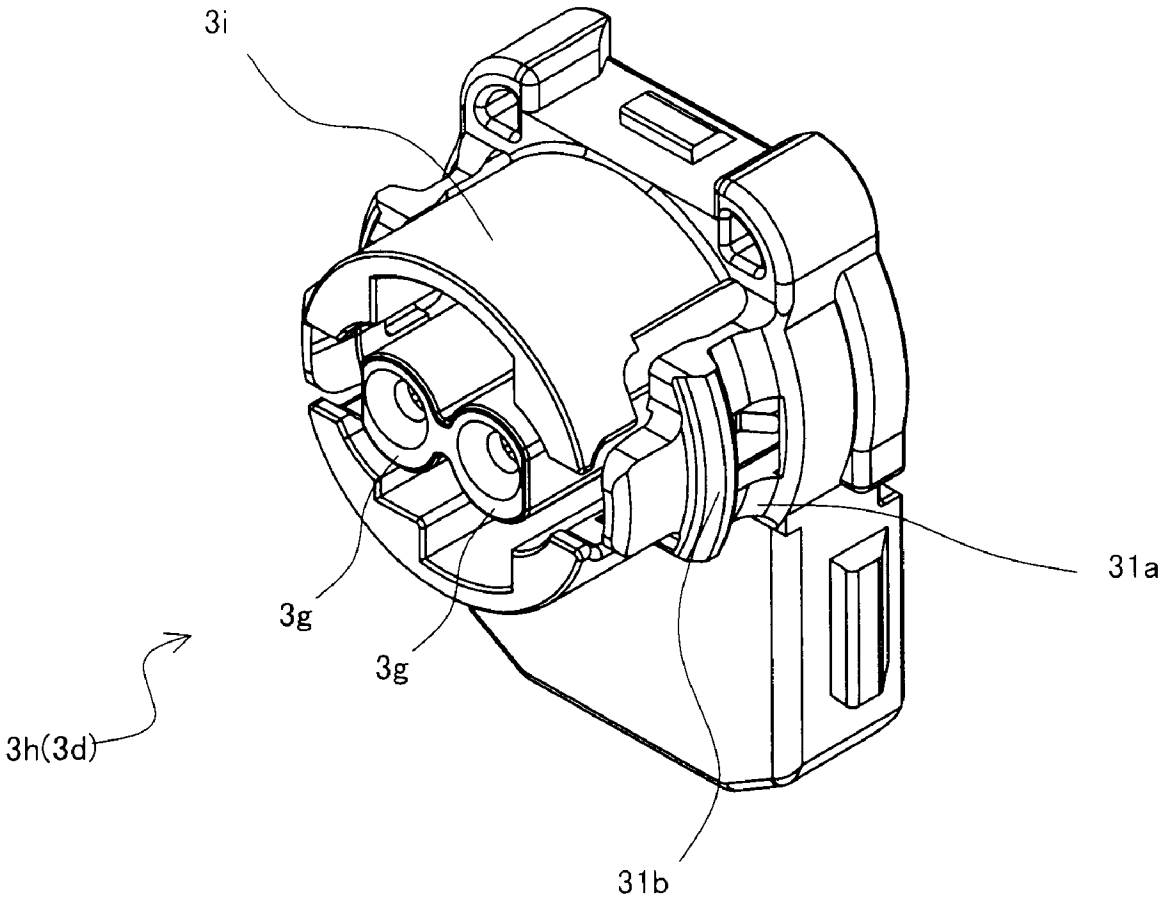
FIG. 4 is a perspective view of a lower housing of FIG. 3.

Next, the plug housing 3*h* will be described with reference to FIG. 3 and FIG. 4. FIG. 3 is an exploded perspective view of the plug housing 3*h*, and FIG. 4 is a perspective view of a lower housing 3*d*, corresponding to a view (bottom view) along the arrow G of FIG. 3. The plug housing 3*h* is a structure for securing mechanical strength and structural strength of the plug element 3, and inside the plug housing 3*h*, the pair of female terminals 30 are attached.

The plug housing 3*h* has an inserting portion 3*i* and a box-shaped box portion 3*b*, and is formed into substantially an L shape (see FIG. 2). In the following description, "main body of the plug element 3 means the inserting portion 3*i* and the box portion 3*b* of the plug housing 3*h*. The plug housing 3*h* is formed by a combination of two parts of an upper housing 3*u* and the lower housing 3*d*. In detail, the lower housing 3*d* forms the inserting portion 3*i* and the box portion 3*b* (lower section), and the upper housing 3*u* forms the box portion 3*b* (upper section) (see FIG. 3).

Figure 5:
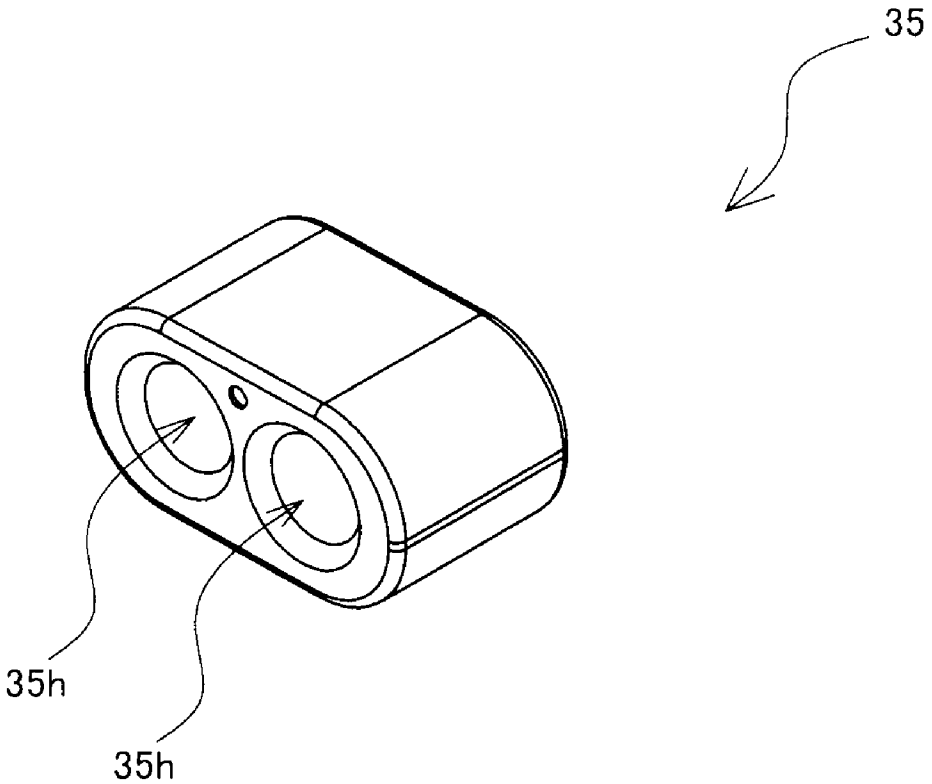
FIG. 5 is a perspective view of ferrite of FIG. 2.

At a portion sandwiched between the upper housing 3*u* and the lower housing 3*d* inside the box portion 3*b*, a box-shaped space 3*f* is formed, and ferrite 35 is disposed herein. The ferrite 35 is provided for removing noise, and is substantially a box-shaped homogeneous substance formed as shown in FIG. 5, and inside this, two through holes 35*h* parallel to each other are formed. The two electric wires 33 are wired so as to reach the outside of the plug housing 3*h* through the insides of the two through holes 35*h*.

The plug housing 3*h* is formed so as to insulate the pair of female terminals 30 from each other. In detail, the plug housing 3*h* is provided with a pair of terminal protectors 3*g* formed into cylindrical shapes radially surrounding peripheries of the outer peripheral walls 30*w* of the female terminals 30, respectively (see FIG. 4). The pair of terminal protectors 3*g* are formed along the outer peripheral walls 30*w* in a radial section.

At a position on the upper surface of the box portion 3*b* of the plug element 3, a concave portion 3*k* is formed (see FIG. 3). In the upper housing 3*u*, two through holes 32*b* and a through hole 32*a* are formed from the concave portion 3*k*. In the lower housing 3*d*, two similar through holes 30*b* and a through hole 30*a* are formed so as to correspond to the two through holes 32*b* and the through holes 32*a* when combined with the upper housing 3*u*. Into the through holes formed in the plug housing 3*h*, the respective projecting portions (described later) of the latching element 50 are inserted.

Figure 12:
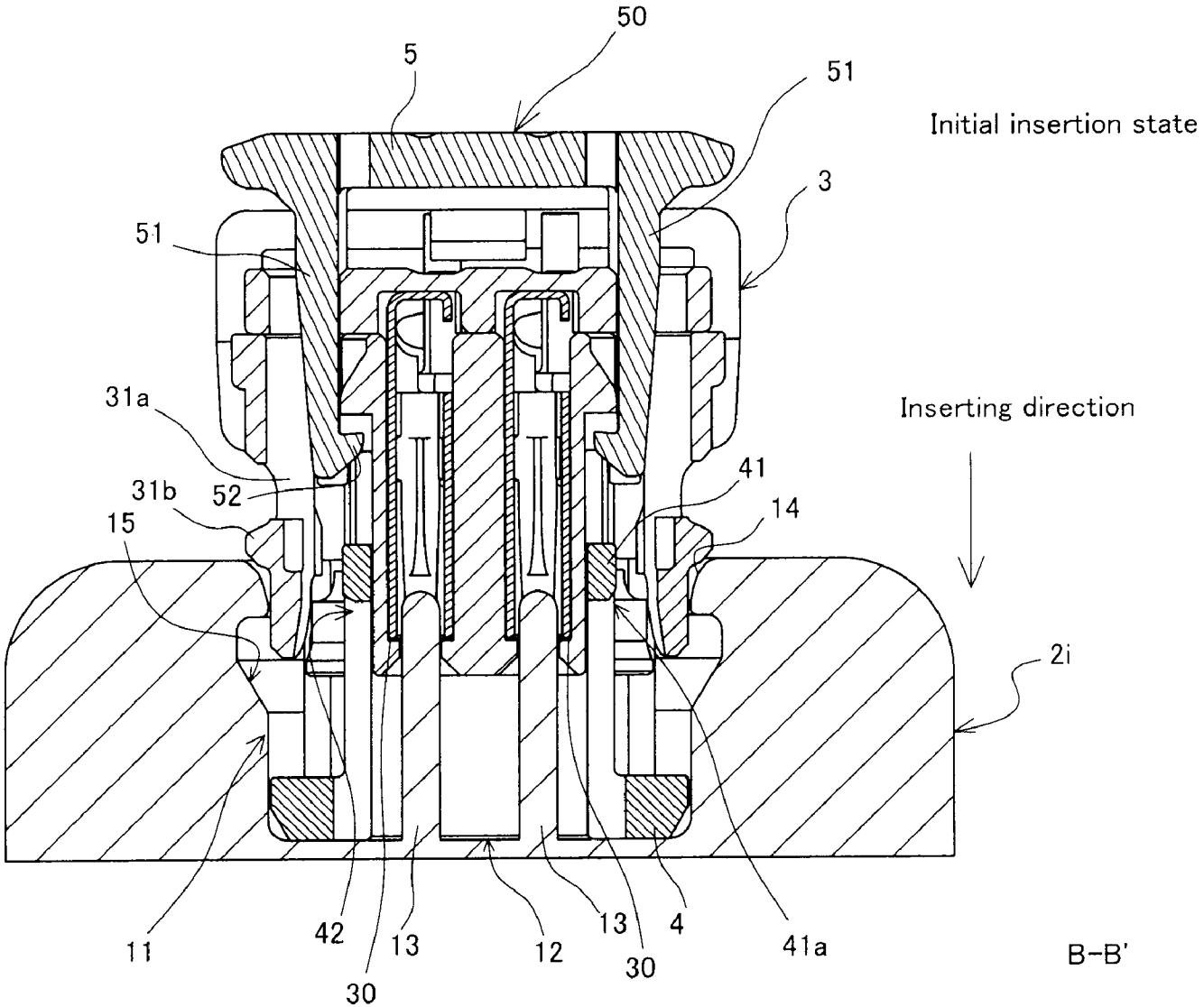
FIG. 12 is a schematic sectional view showing an initial insertion state in the connecting operation of the electrical connection device of FIG. 1.

As shown in FIG. 3, FIG. 4, and FIG. 12, the plug element 3 has two support portions 31*a* formed so as to project from the main body of the plug element 3, and on the tip ends of the respective support portions 31*a*, engaging convex portions 31*b* which engage with the engaging concave portion 15 are formed. By fitting the engaging convex portions 31*b* into the engaging concave portion 15, the plug element 3 is engaged with the socket element 2*i*.

The plug element 3 includes two latch receiving convex portions 36 formed so as to project inside each of the two through holes 30*b* of the lower housing 3*d*, and at the front sides in the inserting direction of the latch receiving convex portions 36, contacted surfaces 36*s* are formed (see FIG. 3, FIG. 8 through FIG. 10, and FIG. 17).

(Short-circuiting Element)

Next, the short-circuiting element 4 will be described with reference to FIG. 2 and FIG. 6. The short-circuiting element 4 electrically short-circuits the pair of pins 13, and engages with the socket 2*h* as a columnar space provided in the socket element 2*i*. The "inserting direction" corresponds to the axial direction of the socket 2*h*, and the inserting direction and the axial direction of the socket 2*h* are orthogonal to the radial direction of the socket 2*h*.

In the short-circuiting element 4, a pair of insertion holes 4*h* are formed (see FIG. 6), and in the respective insertion holes 4*h*, the terminal protectors 3*g* can be inserted. The insertion holes 4*h* are formed along the terminal protectors 3*g* in a radial section.

Figure 6:
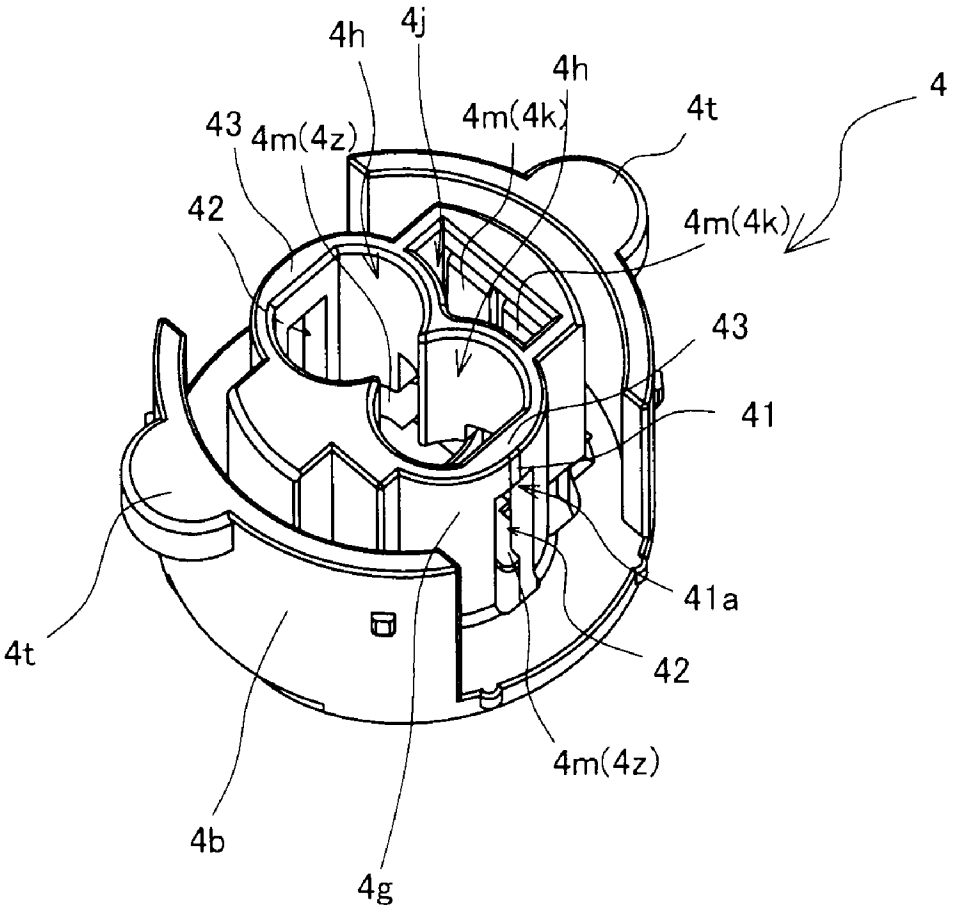
FIG. 6 is a perspective view of a short-circuiting element of FIG. 2.

As shown in FIG. 2 and FIG. 6, the short-circuiting element 4 has a columnar plastic-made main body 4*b* which is molded so as to tightly fit into the socket 2*h*. On the upper surface side portions of the main body 4*b*, two projections 4*t* arranged so as to be received in the two concave portions 2*t* of the socket 2*h* are formed. These projections 4 tare formed into half-column shapes in a top view. By fitting the two projections 4*t* into the two concave portions 2*t*, the short-circuiting element 4 is arranged at a proper circumferential position (position in rotation direction) with respect to the socket 2*h*. The two insertion holes 4*h* of the main body 4*b* are provided so as to penetrate through the short-circuiting element 4 at least vertically. Then, according to provision of the two insertion holes 4*h*, when the short-circuiting element 4 is inserted into the socket 2*h*, the insertion of the short-circuiting element 4 is not obstructed by the contact with the pair of pins 13. The two insertion holes 4*h* serve as insertion guides, so that when the plug element 3 is inserted into the short-circuiting element 4, the insertion of the plug element 3 is not obstructed by contact with the pair of pins 13.

The above-described short circuit is realized by a short-circuiting piece 4*m* supported inside the short-circuiting element 4 (see FIG. 2 and FIG. 6). The short-circuiting piece 4*m* is made of a conductive material that is as elastic as spring steel. The short-circuiting piece 4*m* is provided as a safety means for preventing erroneous operation of the airbag assembly due to a charge leak and erroneous connection during manufacturing of the airbag assembly. A part of this short-circuiting piece 4*m* is inclined toward the side of contact with the pair of pins 13, and between the pair of pins 13 and the same, an electrical short circuit is formed. The short-circuiting piece 4*m* includes a plate-like base portion 4*y* extending vertically (in FIG. 2), a pair of legs 4*k* which are bent at the upper side of the base portion 4*y* and extend diagonally downward, and a pair of contact portions 4*z* which are bent at the lower sides of the pair of legs 4*k* and extend horizontally (see FIG. 2 and FIG. 6). The legs 4*k* are bent into steps toward a direction of separating from the base portion 4*y*, and deflected toward the pair of pins 13. By contact of the pair of contact portions 4*z* with the pair of pins 13, the pair of pins 13 and the short-circuiting piece 4*m* are electrically connected (see FIG. 2). In the short-circuiting element 4, a through hole 4*j* penetrating in the inserting direction is formed (see FIG. 6).

When the latching element 50 is inserted into the plug element 3 inserted into the socket element 2*i*, the second leg 53 of the latching element 50 described later is inserted into this through hole 4*j*. Then, when the latching element 50 is completely inserted to the second latching position, the short-circuiting piece 4*m* is pushed by the tip end of the second leg 53 and separates from the pins 13 (see the arrow F in FIG. 2), and accordingly, the short-circuited state is removed, so that a circuit is formed so as to enable an ignition operation by the squib 4*s*. FIG. 2 shows a state where the short-circuiting piece 4*m* and the pair of pins 13 are in contact with each other.

The short-circuiting element 4 has two latch receiving portions 41*a*, and the latch receiving portions 41*a* are formed so as to engage with the latch portions 52 of the latching element 50. The short-circuiting element 4 has two outer peripheral walls (walls) 4*g*. Hereinafter, one outer peripheral wall 4*g* will be described. The outer peripheral wall 4*g* is formed into a cylindrical shape into which the terminal protector 3*g* is inserted and which surrounds the periphery of the pin 13, and inside the outer peripheral wall 4*g*, an insertion hole 4*h* is formed. The latch receiving portion 41*a* is formed on this outer peripheral wall 4*g*.

On the outer peripheral wall 4*g*, in order from the side of the plug element 3, an end portion 43 of the outer peripheral wall 4*g* and the latch receiving portion 41*a* are formed along the inserting direction. In detail, in the outer peripheral wall 4*g*, a through groove 42 is formed so as to penetrate through the outer peripheral wall 4*g* along the inserting direction. On the outer peripheral wall 4*g*, a bridge 41 formed to connect both wall elements sandwiching the through groove 42 above the through groove 42 is provided (see FIG. 6 and FIG. 8). On the bridge 41, the end portion on the innermost side in the inserting direction (end portion facing the through groove 42) serves as the latch receiving portion 41*a*. The end portion 43 is an end portion of the outer peripheral wall 4*g*, and also an end portion of the bridge 41. In this embodiment, the latch receiving portion 41*a*, the through groove 42, and the bridge 41 are thus constructed, however, the form of the latch receiving portion is not limited to this as long as it catches the latch portion 52.

In this embodiment, the latch receiving portion 41*a* is provided on the outer peripheral wall 4*g*, however, the invention is not limited to this form. For example, it is also allowed that the short-circuiting element is provided with a wall formed along the inserting direction, and on this wall, in order from the side of the plug element 3, an end portion of the wall and the latch receiving portion are arranged along the inserting direction. In this embodiment, this outer peripheral wall 4*g* corresponds to this wall. However, it is also allowed that the wall is provided as a member separate from the outer peripheral wall into which the terminal protector is inserted, and the wall is provided with a latch receiving portion.

(Latching Element)

Figure 7:
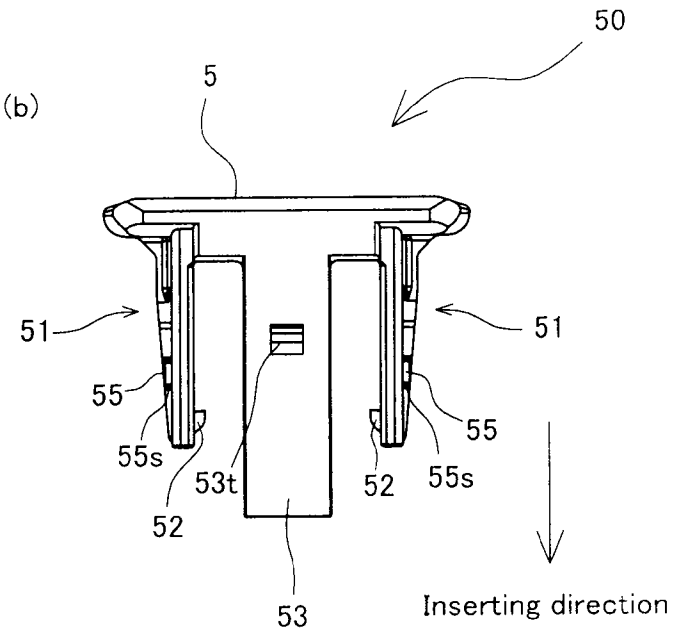
FIG. 7 are schematic views of a latching element of FIG. 2, where FIG. 7(*a*) is a perspective view and FIG. 7(*b*) is a front view.
Figure 7:
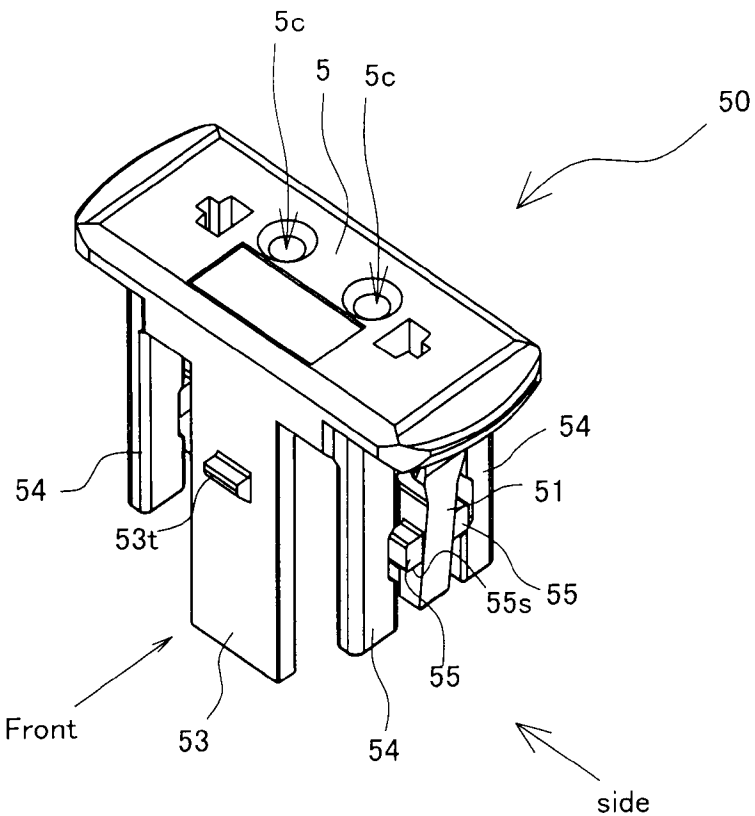
Figure 11:
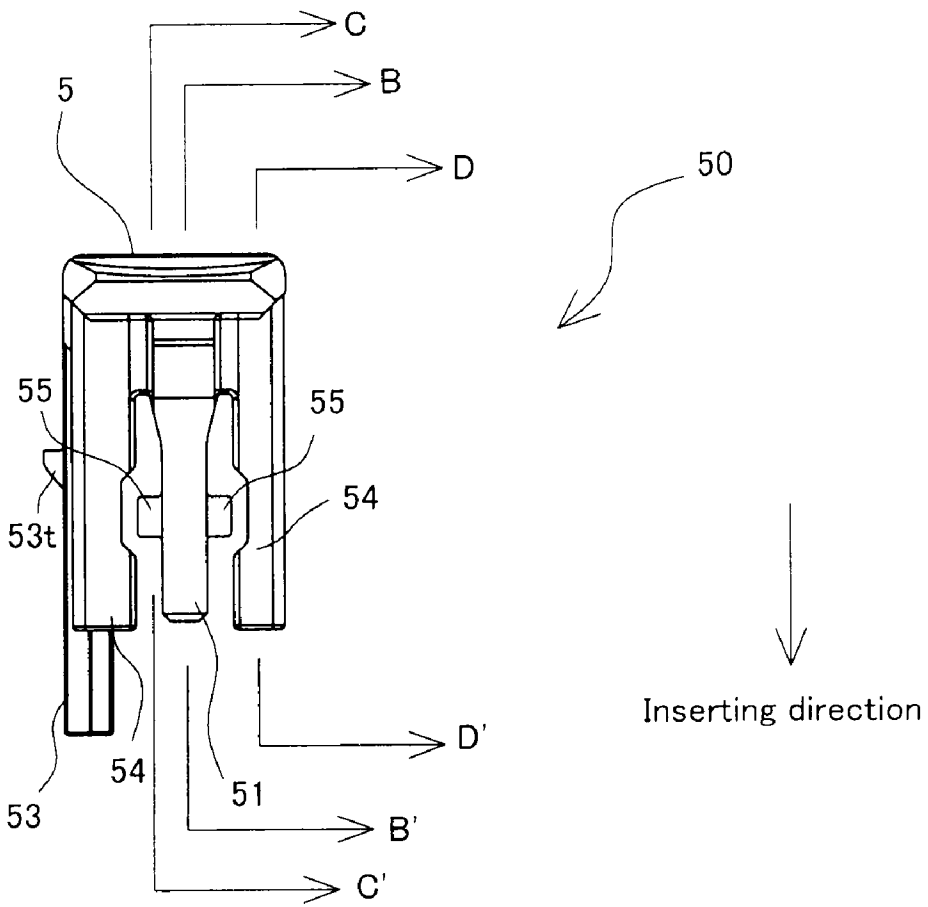
FIG. 11 is a side view of the latching element of FIG. 2.

Next, the latching element 50 will be described with reference to FIG. 7 and FIG. 11. FIG. 7(*a*) is a perspective view of the latching element 50, and FIG. 7(*b*) is a front view thereof. FIG. 11 is a side view (refer to the arrows of FIG. 7(*a*) for the orientations of the front face and the side face). The latching element 50 is latched on the plug element 3 at the first latching position and the second latching position. The latching element 50 is attached to the plug element 3 movably between the first latching position and the second latching position. In the state where the plug element 3 is inserted into the socket element 2*i*, when the latching element 50 is at the second latching position, the short-circuiting piece 4*m* moves to the non-short-circuit position.

The latching element 50 has a pushed portion 5 to be pushed, and from the pushed portion 5, a pair of first legs 51, four restricting portions 54, and a second leg 53 are formed in a projecting manner along the inserting direction. In other words, the two first legs 51, the four restricting portions 54, and the second leg 53 project along the inserting direction (inserting direction when the latching element 50 is at the first latching position in the state where the plug element 3 is inserted into the socket element 2*i*).

The pushed portion 5 is a plate-like member having a rectangular shape (having shorter sides and longer sides) in a plan view. Two conduction holes 5*c* to be used for a continuity check of the pair of female terminals 30 are penetrated through the pushed portion 5.

The pair of first legs 51 are arranged on both ends in the longitudinal direction of the pushed portion 5 as shown in FIG. 7. Each first leg 51 has a latch portion 52 formed in a projecting manner on the tip end of the first leg. The pair of first legs 51 are arranged so that the pair of latch portions 52 are opposed to each other (see FIG. 7(*b*) and FIG. 12 through FIG. 16). On the pair of first legs 51, the pair of latch portions 52 are formed so as to project to each other. In other words, in the state where the latching element 50 is latched on the plug element 3 and the plug element 3 is inserted into the socket element 2*i*, the pair of latch portions 52 project toward the radially inner side (toward the center side) of the socket 2*h*. It is preferable that the latch portions thus project in a direction orthogonal to the inserting direction.

The two latch portions 52 engage with two latch receiving portions 41*a*. Therefore, when the latching element 50 is pushed in the inserting direction, separation between the plug element 3 and the socket element 2*i* is prevented by this latching element 50. The latch portions may be provided on the short-circuiting element, and in this case, correspondingly, latch receiving portions may be provided on the latching element.

On both sides of the first leg 51 (both sides in the direction of the shorter side of the pushed portion 5), a pair of latching convex portions 55 are formed in a projecting manner. On the inner sides of the inserting direction (inserting direction in the state where the latching element 50 is latched on the plug element 3 and the plug element 3 is inserted into the socket element 2*i*) of the respective latching convex portions 55, contact surfaces 55*s* are formed (see FIG. 7(*b*), FIG. 8 through FIG. 10, and FIG. 17).

The second leg 53 is formed into a plate shape. In the state where the plug element 3 is inserted into the socket element 2*i*, when the latching element 50 is at the second latching position, the second leg 53 is inserted into the through hole 4*j* and comes into contact with the short-circuiting piece 4*m* to move the short-circuiting piece 4*m* to the non-short-circuit position. The second leg 53 is provided with a projection 53*t*. The projection 53*t* functions as a stopper of the latching element 50 by being caught in a concave portion formed on the plug element 3. The second leg 53 is arranged on the longitudinal side of the pushed portion 5, and the normal direction thereof is along the direction of the shorter side of the pushed portion 5.

The four restricting portions 54 restrict the movement of the plug element 3 so as to prevent the plug element 3 from coming off the socket element 2*i* when the latching element 50 is at the second latching position in the state where the plug element 3 is inserted into the socket element 2*i* (details will be described later). On both sides (both sides in the direction of the shorter side of the pushed portion 5) of each first leg 51, two restricting portions 54 are arranged.

These projecting portions are inserted into the two through holes 32*b* and the through hole 32*a* formed in the upper housing 3*u* of the plug element 3 and the two through holes 30*b* and the through hole 30*a* formed in the lower housing 3*d*. In detail, in the two through holes 32*b* and two through holes 30*b*, the pair of first legs 51 and the four restricting portions are inserted, and in the through hole 32*a* and the through hole 30*a*, the second leg 53 is inserted.

The connector 8 and the electrical connection device 1 of the present embodiment are constructed as described above. It is preferable that the plug element 3, the short-circuiting element 4, and the latching element 50 are molded from a low-conductivity plastic material except for various leads and terminals.

(Connecting Operation)

Figure 8:
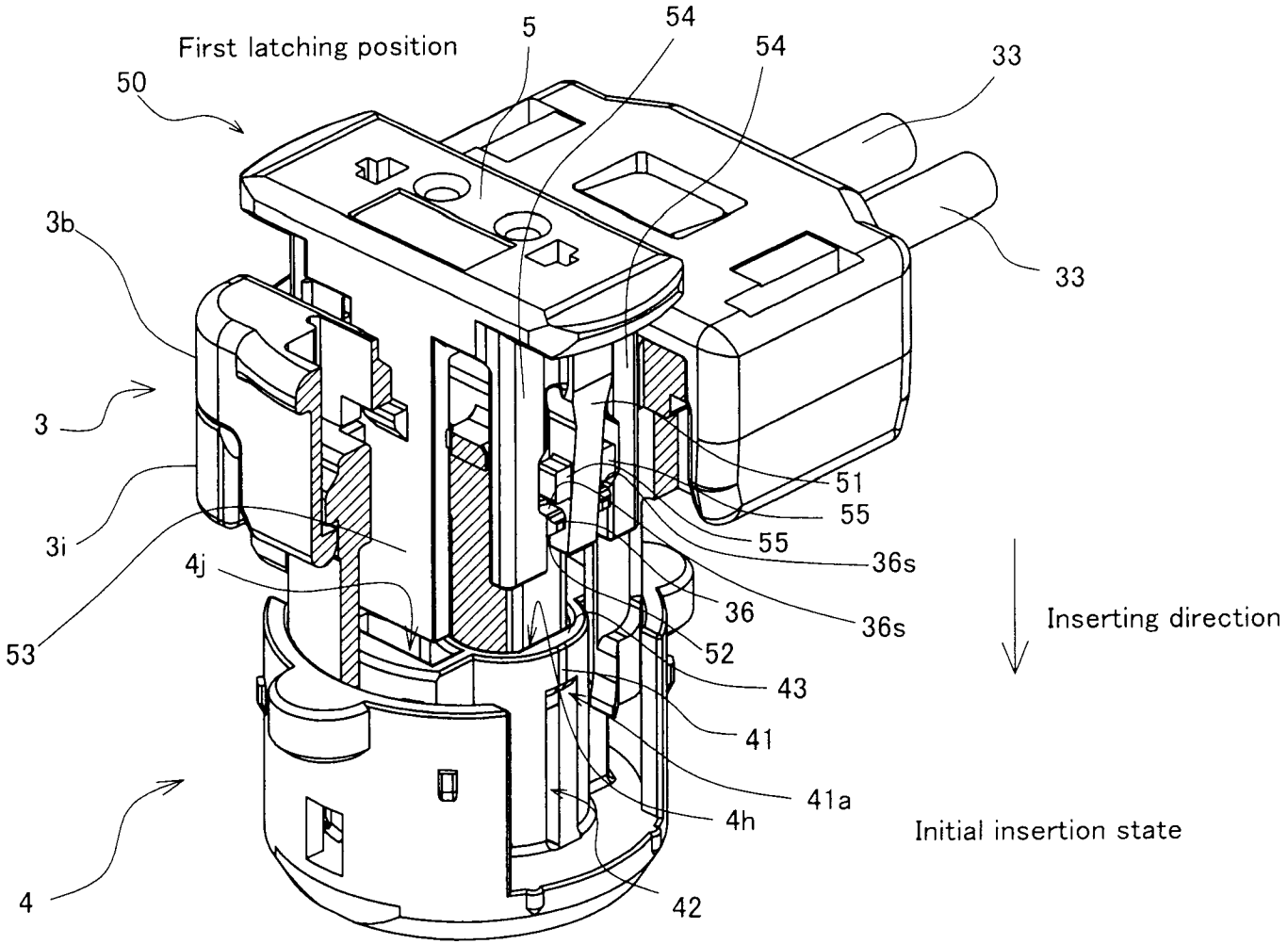
FIG. 8 is a partial sectional perspective view showing an initial insertion state in a connecting operation of the electrical connection device of FIG. 1.
Figure 9:
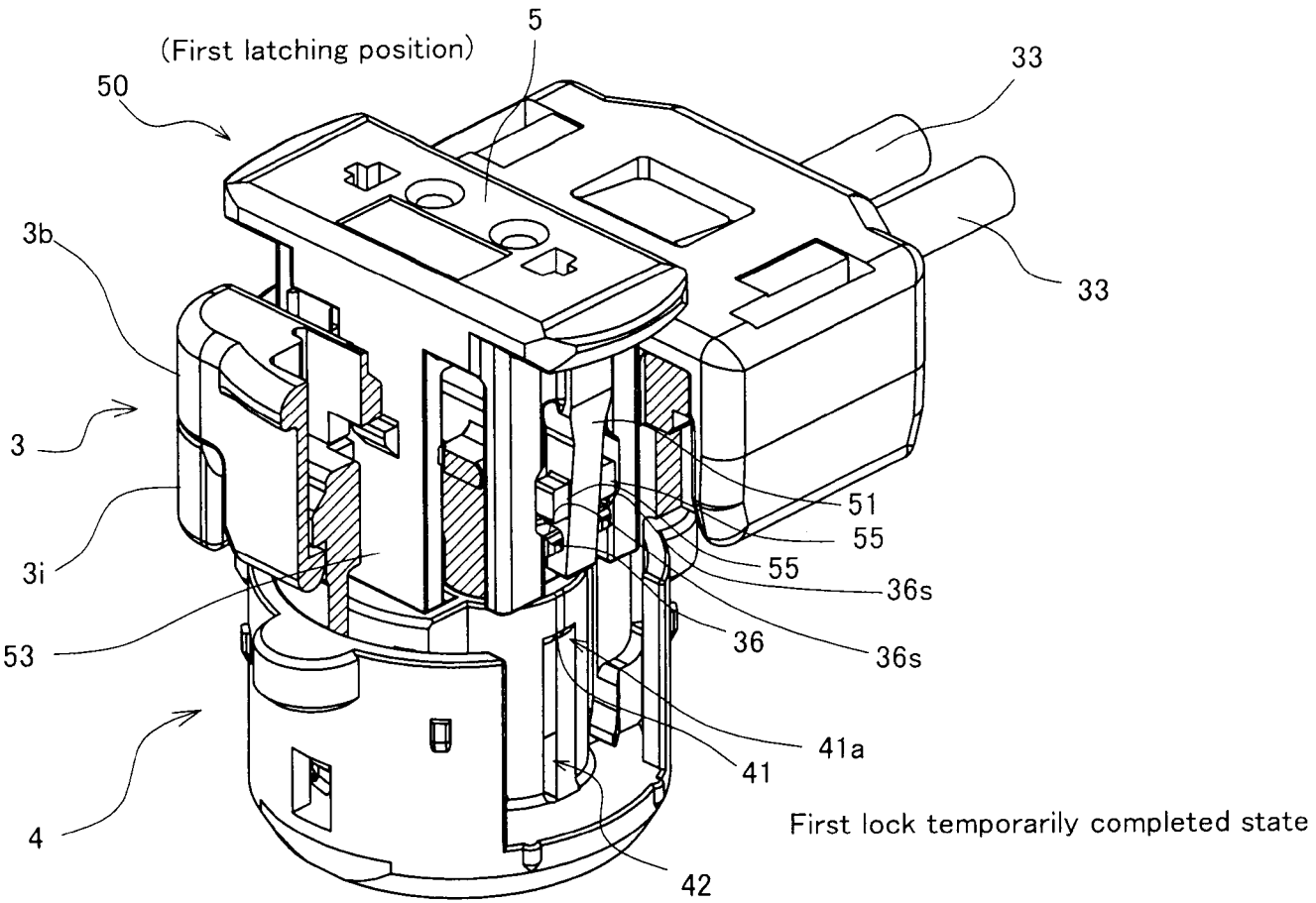
FIG. 9 is a partial sectional perspective view showing a first lock completed state in the connecting operation of the electrical connection device of FIG. 1.
Figure 10:
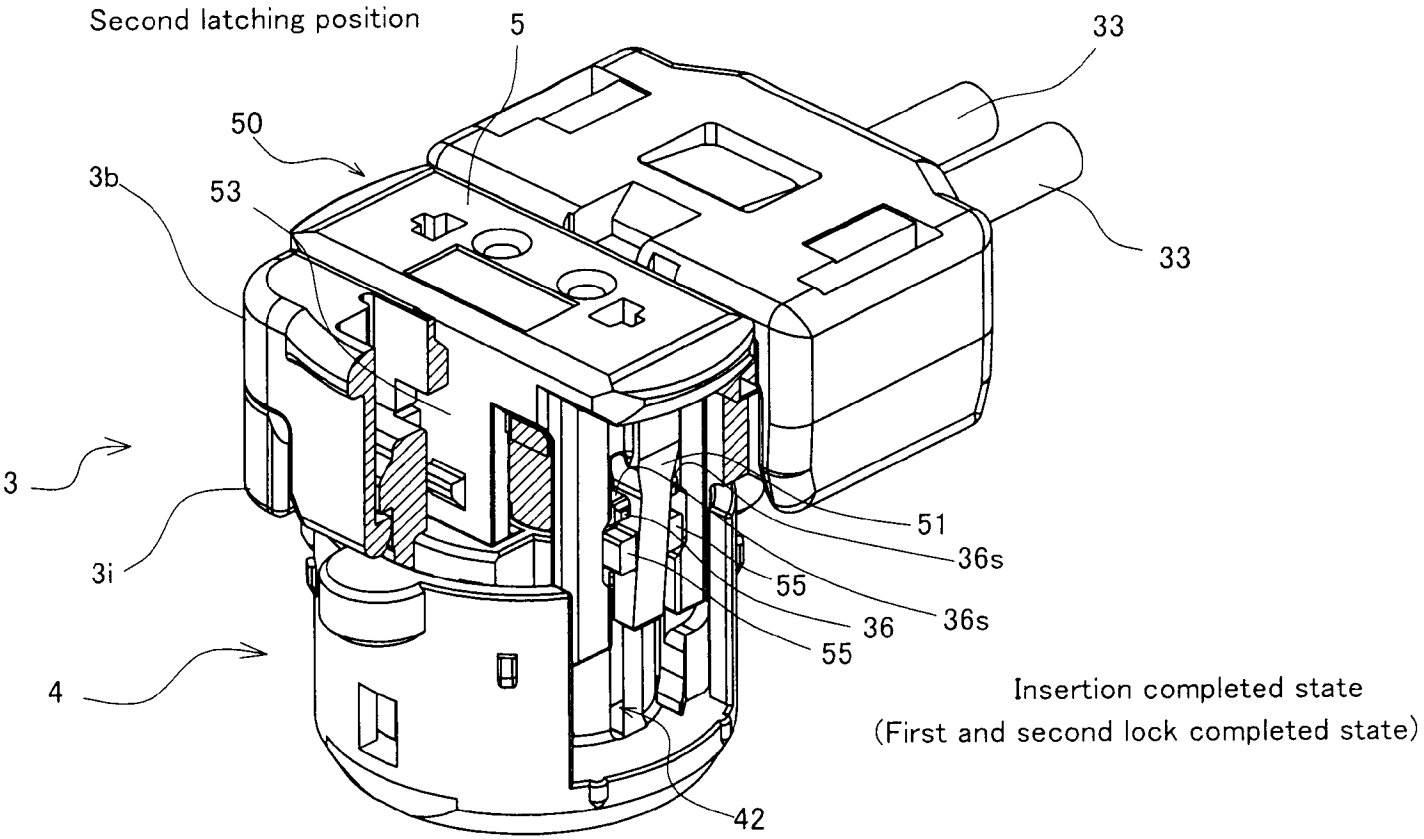
FIG. 10 is a partial sectional perspective view showing a second lock completed state in the connecting operation of the electrical connection device of FIG. 1.

Next, the connecting operation of the connector 8 and the electrical connection device 1 will be described with reference to the drawings. FIG. 8 through FIG. 10 are partial sectional perspective views showing respective stages of the connecting operation, and FIG. 12 through FIG. 16 are schematic sectional views showing respective stages of the connecting operation. FIG. 17 are explanatory views schematically showing respective stages of the connecting operation in the vicinity of the portion indicated by A in FIG. 15, and FIG. 18 is a schematic sectional view showing an insertion completed state. Herein, sections of FIG. 12 through FIG. 16 correspond to the section along B-B' of FIG. 11, and the sections of FIG. 17 correspond to the section along C-C' of FIG. 11, and the section of FIG. 18 corresponds to the section along D-D' of FIG. 11.

In an initial state, as shown in FIG. 2, the short-circuiting element 4 is fitted in advance in the socket 2*h* of the socket element 2*i*, and the pair of pins 13 are short-circuited. As shown in FIG. 2, the latching element 50 is latched in advance on the plug element 3 at the first latching position. FIG. 17(*a*) shows this state.

Herein, for example, a state where the side surface of the box portion 3*b* of the plug element 3 is held by hand, and thereafter, the lower end of the inserting portion 3*i* is inserted into the socket 2*h* of the socket element 2*i*, is shown in FIG. 8 and FIG. 12. FIG. 8 and FIG. 12 show an initial insertion state of the plug element 3 into the socket element 2*i*. In this state, the engaging convex portions 31*b* of the support portions 31*a* butt against the inclined surface 14 of the entrance of the socket 2*h* and stop. In this state, the pair of female terminals 30 and the pair of pins 13 have started coming into contact with each other, however, the latching element 50 is latched at the first latching position, and the short-circuited state is not removed, so that electrical connection between the pair of female terminals 30 and the pair of pins 13 has not been completed yet. The state of FIG. 17(*b*) corresponds to this state.

Figure 13:
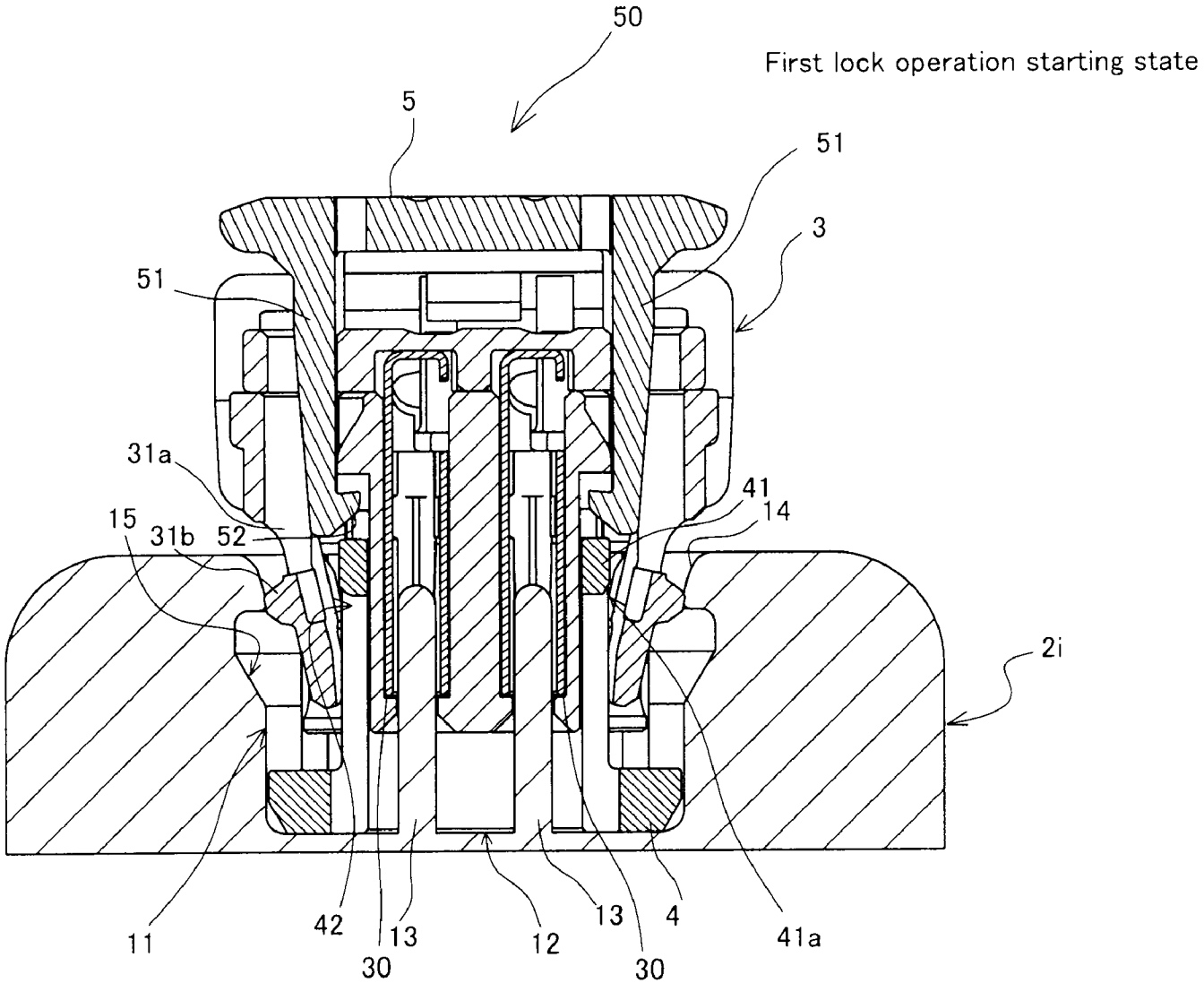
FIG. 13 is a schematic sectional view showing a first lock operation starting state in the connecting operation of the electrical connection device of FIG. 1.

From this state, for example, when the pushed portion 5 of the latching element 50 is pushed with a finger, a force which guides the tip ends of the support portions 31*a* toward the radially inner side is applied to the bases of the support portions 31*a*. FIG. 13 shows a state during this connection. In this state, the engaging convex portions 31*b* on the tip ends of the support portions 31*a* come into contact with the inclined surface 14 of the entrance of the socket 2*h*, and accordingly, the support portions 31*a* bend to the radially inner side of the socket 2*h* (see FIG. 13). Then, this bending of the support portions 31*a* enables the plug element 3 to enter the inside of the socket 2*h*. FIG. 13 shows this state (first lock operation starting state).

Until this operation, the latching element 50 is at the first latching position. At the first latching position, the contact surfaces 55*s* and the contacted surfaces 36*s* come into contact with each other to latch the latching element 50 on the plug element 3 (see FIG. 17(*a*) and FIG. 17(*b*)). In detail, the contact surfaces 55*s* and the contacted surfaces 36*s* are in contact with each other in the inserting direction of the plug element 3 into the socket element 2*i* when the latching element 50 is at the first latching position. Therefore, the plug element 3 and the latching element 50 are integrated and the latching element 50 pushes the plug element 3, and accordingly, the plug element 3 is pushed in the inserting direction into the socket 2*h*.

Figure 14:
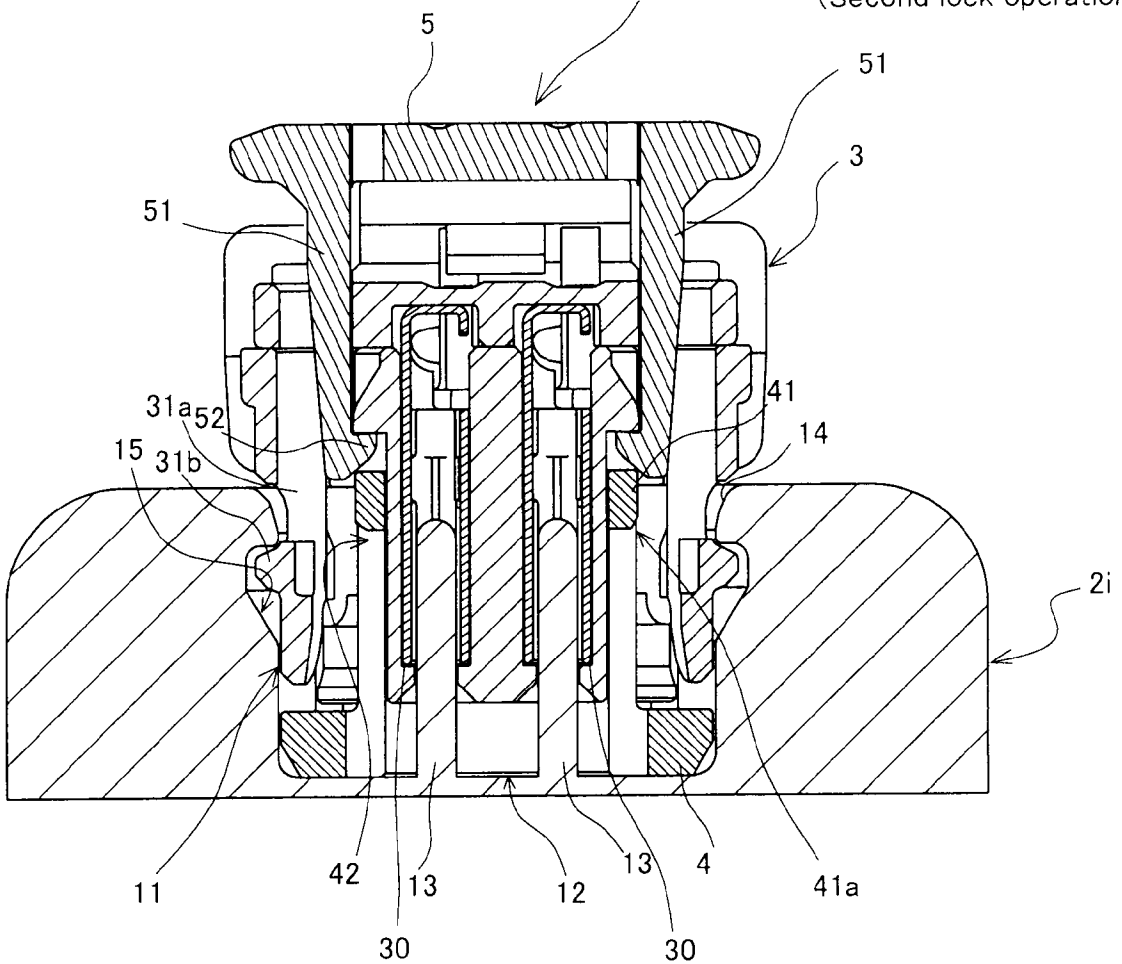
FIG. 14 is a schematic sectional view showing a first lock completed state in the connecting operation of the electrical connection device of FIG. 1.
Figure 15:
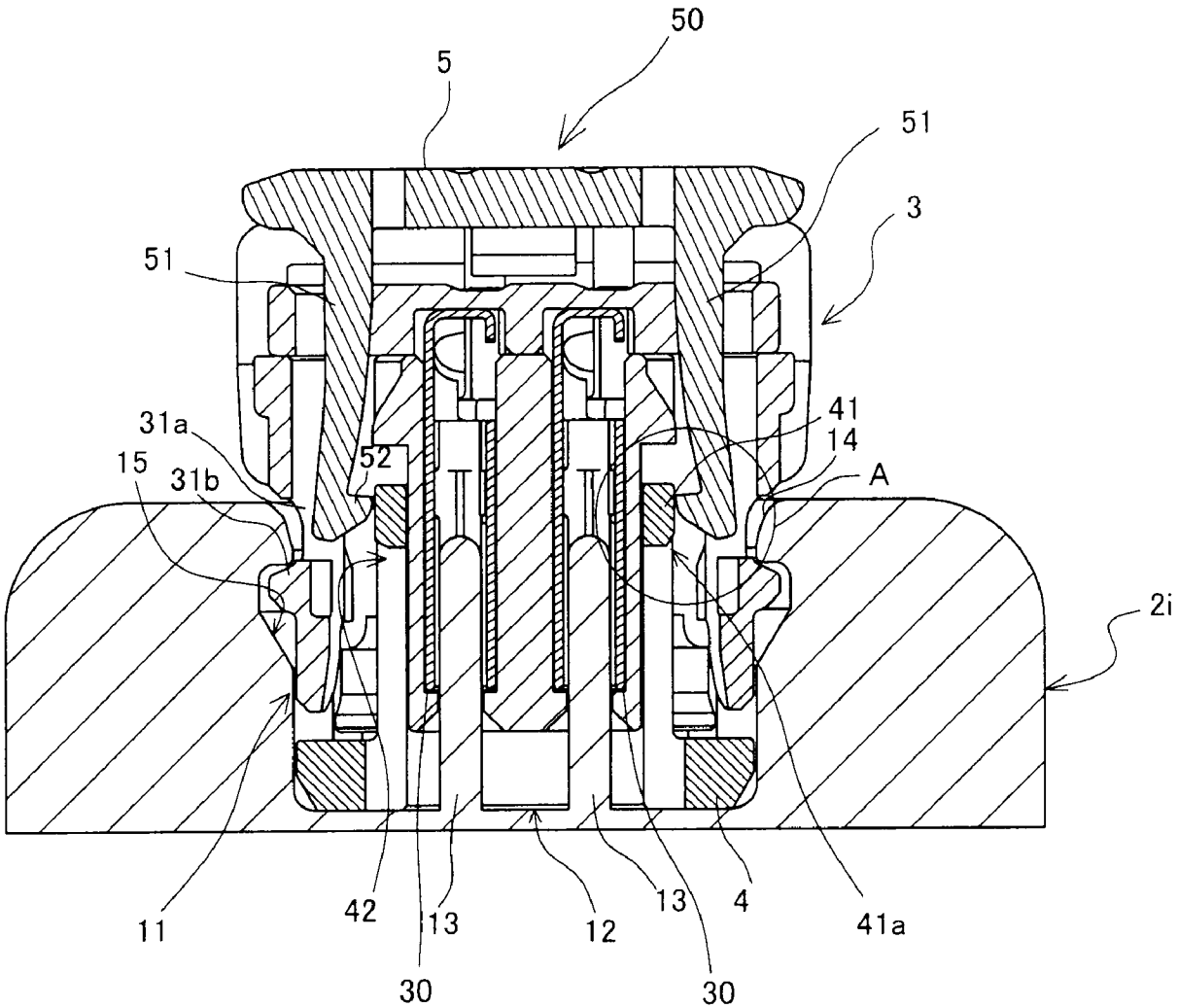
FIG. 15 is a schematic sectional view showing a state during shifting from the first latching position to the second latching position in the connecting operation of the electrical connection device of FIG. 1.

The plug element 3 is thus pushed in, and as shown in FIG. 9 and FIG. 14, the support portions 31*a* that had temporarily bent elastically restore and the engaging convex portions 31*b* are fitted and housed in the engaging concave portion 15, and as a result, the plug element 3 engages with the socket element 2*i* (the states of FIG. 9 and FIG. 14 are referred to as first lock temporarily completed states). Even in this state, the short-circuited state has not been removed yet, so that the electrical connection between the pair of female terminals 30 and the pair of pins 13 has not been completed yet. By the first lock temporary completion, the plug element 3 is inserted to a degree that does not allow it to easily come off the socket element 2*i*, however, the connected state is not complete.

Next, as shown in FIG. 15, the latching element 50 is further pushed in from the first latching position. In detail, at the first latching position, the contact surfaces 55*s* and the contacted surfaces 36*s* come into contact with each other, and accordingly, the latching element 50 is latched on the plug element 3 (see FIG. 17(*b*)). Then, in the state where the plug element 3 is inserted into the socket element 2*i*, when the latching element 50 at the first latching position is pushed, the tip ends (latch portions 52) of the first legs 51 and the end portions 43 of the outer peripheral walls 4*g* come into contact with each other, and the first legs 51 elastically bend to the radially outer sides of the outer peripheral walls 4*g* (see the direction H of FIG. 17(*c*)) (see FIG. 15). Then, according to this bending of the first legs 51 outward (bending of the latch portions 52 toward the radially outer sides), as shown in FIG. 17(*c*), the latching convex portions 55 come apart from the positions of the latch receiving convex portions 36, and the contact surfaces 55*s* and the contacted surfaces 36*s* separate from each other. Accordingly, the latching at the first latching position is released, and the latching element 50 becomes movable to the second latching position. In this state, "the radially outer sides of the outer peripheral walls 4*g*" correspond to "radially outer sides of the socket 2*h*."

In more detail, on the respective first legs 51, surfaces on the inner sides in the radial direction of the socket 2*h* of the latch portions 52 on the tip ends are inclined by substantially 45 degrees with respect to the inserting direction. The latch portions 52 are formed so that their portions on the inner sides in the radial direction come to the front side in the inserting direction (portions on the outer sides in the radial direction come to the more inner side in the inserting direction). The latch portions 52 are thus formed, so that the first legs 51 easily bend radially outward when these inclined surfaces of the latch portions 52 come into contact with the end portions 43.

In the description of the short-circuiting element 4, it is described that not the outer peripheral walls 4*g* but separate walls may be provided, and in this case, the walls are constructed as follows. That is, the walls are constructed so that, in the state where the plug element 3 is inserted into the socket element 2*i*, when the latching element 50 at the first latching position is pushed, the first legs 51 and the end portions of the walls come into contact with each other and the first legs 51 elastically bend, and accordingly, the latching at the first latching position is released, and the latching element 50 becomes movable to the second latching position.

Figure 16:
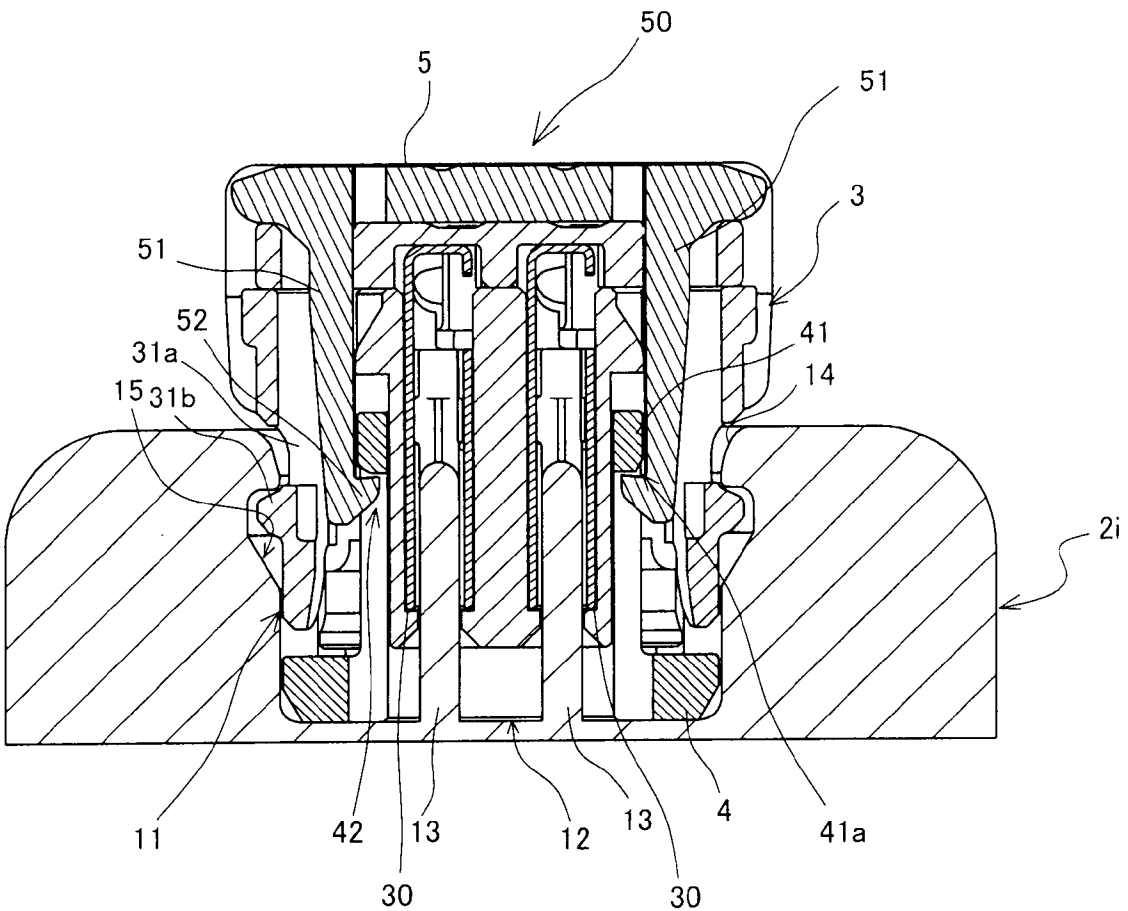
FIG. 16 is a schematic sectional view showing an insertion completed state in the connecting operation of the electrical connection device of FIG. 1.
Figure 17:
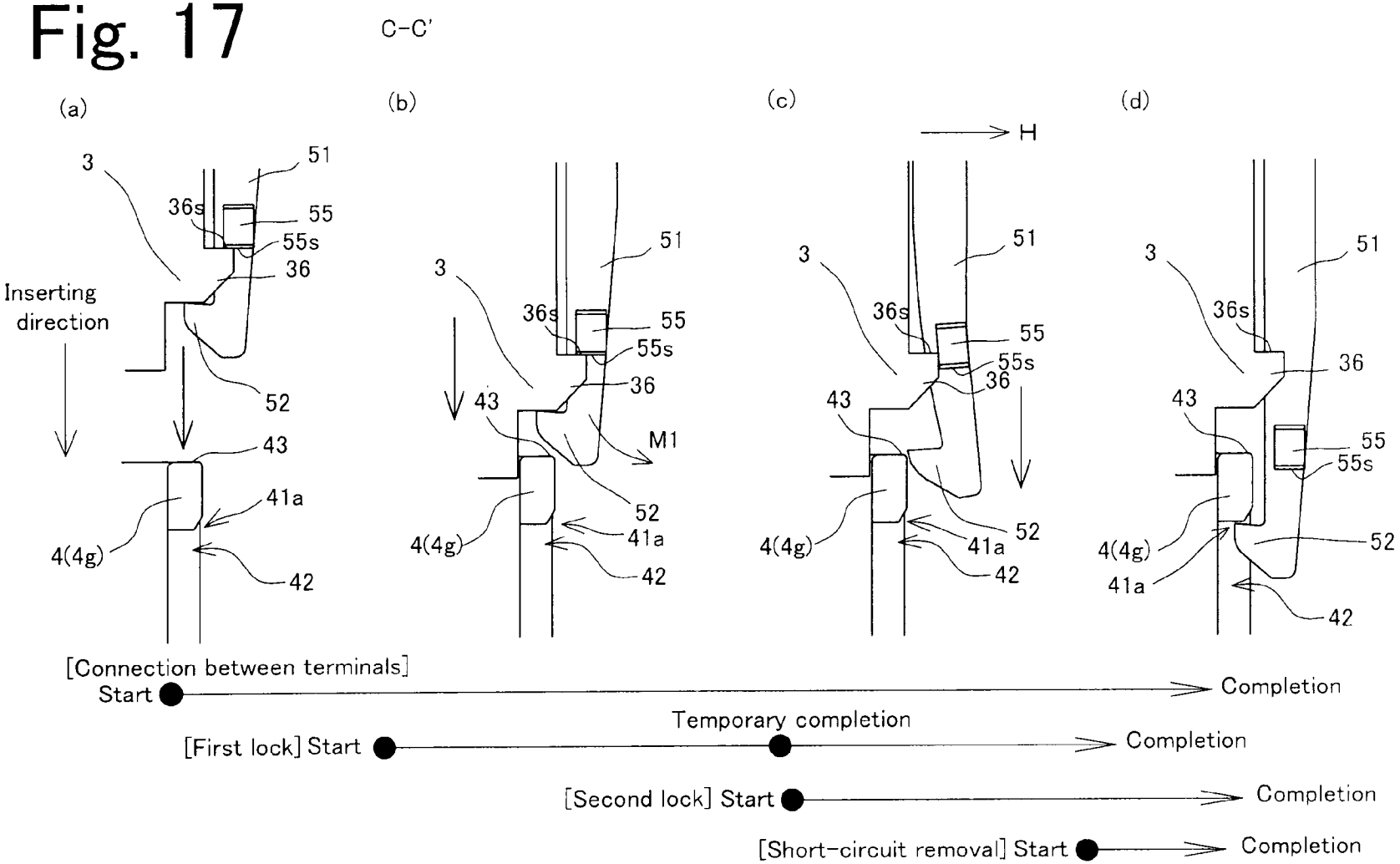
FIG. 17 are explanatory views schematically showing the respective stages of the connecting operation of the electrical connection device of FIG. 1, where FIG. 17(*a*) shows a state before insertion, FIG. 17(*b*) shows an initial insertion state, FIG. 17(*c*) shows a state during shifting from the first latching position to the second latching position, and FIG. 17(*d*) is an insertion completed state.
Figure 18:
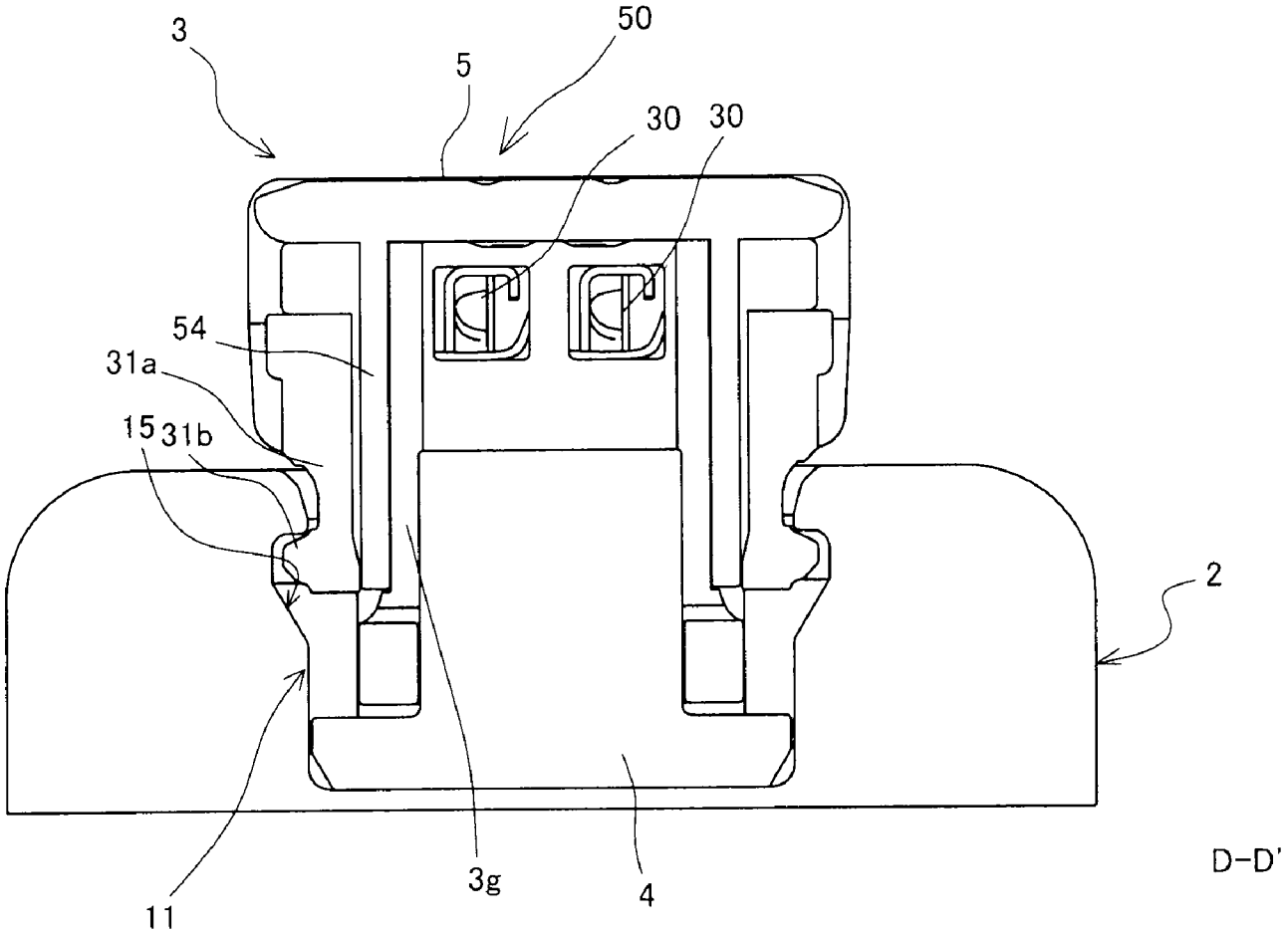
FIG. 18 is a schematic sectional view showing an insertion completed state in the connecting operation of the electrical connection device of FIG. 1.

When the latching element 50 is further pushed in, as shown in FIG. 10, FIG. 16, and FIG. 17(*d*), the latching element 50 moves to the second latching position, and the connection between the socket element 2*i* and the plug element 3 is completed (insertion completed state).

In detail, in the state where the plug element 3 is inserted into the socket element 2*i*, the latching element 50 is at the second latching position, and the two latch portions 52 and the two latch receiving portions 41*a* engage with each other, and accordingly, the latching element 50 is attached to the short-circuiting element 4 (second lock completed state, see FIG. 16 and FIG. 17(*d*)).

Then, for example, unless a pointed member is inserted between the pushed portion 5 of the latching element 50 and the concave portion 3*k* of the plug element 3 and only the latching element 50 is pulled up, the latching element 50 cannot be detached from the plug element 3 and the socket element 2*i*.

In the state where the plug element 3 is inserted into the socket element 2*i*, when the latching element 50 is at the second latching position, the four restricting portions 54 restrict the movement of the plug element 3 so as to prevent the plug element 3 from coming off the socket element 2*i*. In detail, the respective four restricting portions 54 are inserted between the terminal protectors 3*g* and the support portions 31*a* and restrict the movement of the engaging convex portions 31*b* so as to come off the engaging concave portion 15 (the movement of the support portions 31*a* to bend toward the radially inner side of the socket 2*h*) from the inner side (see FIG. 18). Therefore, the restricting portions 54 function as stoppers of the plug element 3. Accordingly, the first lock that had been temporarily completed is completed. Other than these restricting portions, for example, restricting portions which push (not the entire support portions 31*a* but) only the tip ends of the support portions 31*a* from the inner side may also be used.

In this state, the pair of pins 13 are completely inserted into the pair of female terminals 30. Further, in conjunction with the operation for connecting the socket element 2*i* and the plug element 3, the contact portions 4*z* withdraw from the pair of pins 13 in response to insertion of the second leg 53 of the latching element 50, and the short-circuited state between the pair of pins 13 by the short-circuiting piece 4*m* is removed. Accordingly, the electrical connection between the pair of female terminals 30 and the pair of pins 13 is completed. That is, electrical connection between the terminals is completed.

Thus, by one operation of pushing the latching element 50, the mechanical engagement and electrical connection between the socket element 2*i* and the plug element 3 via the latching element 50 is completed (insertion completed state). By the latching element 50, removal of the short-circuited state, confirmation of the connected state, and prevention of separation between the plug element 3 and the socket element 2*i* are realized.

In the lower sections of FIG. 17, timings of starts through completions of the operations of the connection between terminals, the first lock, the second lock, and short-circuit removal are shown corresponding to the positions of FIG. 17(*a*) through FIG. 17(*d*).

(Effect)

Effects obtained by the connector 8 and the electrical connection device 1 of the present embodiment will be described. The connector 8 is connectable to a socket element 2*i* supporting a pair of pins 13, and includes a plug element 3 which supports a pair of female terminals 30 to be electrically connected to the pair of pins 13 and is inserted into the socket element 2*i* and engages with the socket element 2*i*; a short-circuiting element 4 which includes a short-circuiting piece 4*m* that electrically short-circuits the pair of pins 13 and is attached to the socket element 2*i*; and a latching element 50 to be latched on the plug element 3 at a first latching position and a second latching position. The latching element 50 is movable between the first latching position and the second latching position, and in the state where the plug element 3 is inserted into the socket element 2*i*, when the latching element 50 is at the second latching position, the short-circuiting piece 4*m* moves to a non-short-circuit position, and the latching element 50 has two latch portions 52 formed in a projecting manner, the short-circuiting element 4 has two latch receiving portions 41*a* formed so as to engage with the two latch portions 52, and in the state where the plug element 3 is inserted into the socket element 2*i*, when the latching element 50 is at the second latching position, the two latch portions 52 and the two latch receiving portions 41*a* engage with each other.

In this construction, when the latching element 50 moves to the second latching position, the short circuit of the pins 13 is removed, and the latching element 50 is attached to the short-circuiting element 4. In addition, the plug element 3 and the socket element 2*i* directly engage with each other. Therefore, in the connector 8 having the latching element 50, the shape of the latching element 50 is determined depending not on the shape of the socket element 2*i* but on only the shapes of the plug element 3 and the short-circuiting element 4. Accordingly, (i) the rising height of the latching element 50 with respect to the plug element 3 main body when the latching element is at the first latching position (temporary latching position), (ii) the engagement of the latching element 50 when the connection of the electrical connection device 1 is completed, and (iii) timings of short-circuit removal and connection completion in the series of connecting operations, etc., can be designed without depending on the shape of the socket element 2*i*. Therefore, in comparison with the case where the latching element is designed and manufactured for each socket element type, the design and manufacturing of the latching element become easy, and reliable connection can be made without depending on the socket element type. As described above, according to this construction, an easy and reliable connection can be made without depending on the shape of the socket element.

Further, in the connector 8, the latching element 50 includes a plate-like pushed portion 5 to be pushed, a pair of first legs 51 formed so as to project from the pushed portion 5, and a second leg 53 formed so as to project from the pushed portion 5, each of the pair of first legs 51 has a latch portion 52, the second leg 53 moves the short-circuiting piece 4*m* to the non-short-circuit position by contact with the short-circuiting piece 4*m* when the latching element is at the second latching position in the state where the plug element 3 is inserted into the socket element 2*i*, and the pair of first legs 51 are arranged so that the two latch portions 52 are opposed to each other. Accordingly, the latching element which works so as to (i) mechanically and electrically connect both components and (ii) remove a short circuit of the short-circuiting element can be formed with a simple construction. The shape of the latching element is not limited to this.

In the connector 8, on the pair of first legs 51, two latch portions 52 are formed so as to project to each other, and the plug element 3 has a pair of terminal protectors 3*g* formed into cylindrical shapes surrounding the peripheries of the pair of female terminals 30, the short-circuiting element 4 has a pair of outer peripheral walls 4*g* formed into cylindrical shapes into which the pair of terminal protectors 3*g* are inserted and which surround the peripheries of the pair of pins 13, and the two latch receiving portions 41*a* are provided on the pair of outer peripheral walls 4*g*. Accordingly, the latching element which works so as to (i) mechanically and electrically connect both components and (ii) remove a short circuit of the short-circuiting element can be formed with a simple construction. In addition, deformation of the pins 13 can be prevented. Therefore, the terminal protectors and outer peripheral walls for preventing deformation of the pins and portions where the latch receiving portions are formed do not have to be provided on separate members, so that the construction of the electrical connection device can be made simple. The operation for connecting both components and the operation for pushing the latching element 50 in for removing a short circuit can be performed by a series of operations at one time.

In the connector 8, the short-circuiting element 4 has a pair of outer peripheral walls 4*g* as a pair of walls provided along the inserting direction of the plug element 3 into the socket element 2*i*, and on each of the pair of outer peripheral walls 4*g*, in order from the side of the plug element 3, an end portion 43 of the outer peripheral wall 4*g* and a latch receiving portion 41*a* are arranged along the inserting direction, and in the state where the plug element 3 is inserted into the socket element 2*i*, when the latching element 50 at the first latching position is pushed, by contact between each of the pair of first legs 51 and the end portions 43, the pair of first legs 51 elastically bend, and accordingly, the latching at the first latching position is released, and the latching element 50 becomes movable to the second latching position. Accordingly, the latching can be easily released by the simple device construction. In addition, the operation for connecting both components and the operation for pushing the latching element in for removing a short circuit can be performed by a series of operations at one time.

As described above, the walls may be the outer peripheral walls 4*g*, or may be separately provided on elements other than the outer peripheral walls.

In the connector 8, the plug element 3 has a pair of terminal protectors 3*g* formed into cylindrical shapes surrounding the peripheries of the pair of female terminals 30, and the short-circuiting element 4 has a pair of outer peripheral walls 4*g* formed into cylindrical shapes into which the pair of terminal protectors 3*g* are inserted and which surround the peripheries of the pair of pins 13, and on each of the pair of outer peripheral walls 4*g*, in order from the side of the plug element 3, an end portion 43 of the outer peripheral wall 4*g* and a latch receiving portion 41*a* are arranged along the inserting direction, and in the state where the plug element 3 is inserted into the socket element 2*i*, when the latching element 50 at the first latching position is pushed, by contact between each of the tip ends of the pair of first legs 51 and each of the end portions 43 of the pair of outer peripheral walls 4*g*, the pair of first legs 51 elastically bend to the radially outer sides of the outer peripheral walls 4*g*, and accordingly, the latching at the first latching position is released, and the latching element 50 becomes movable to the second latching position. Accordingly, deformation of the pins 13 can be prevented, and the latching can be easily released by the simple device construction. In addition, the operation for connecting both components and the operation for pushing the latching element 50 in for removing a short circuit can be performed by a series of operations at one time. The present invention is not limited to this construction.

In the connector 8, when the latching element 50 is at the first latching position in the state where the plug element 3 is inserted into the socket element 2*i*, the pair of first legs 51 project in a direction along the inserting direction of the plug element 3 into the socket element 2*i*. Accordingly, the device construction which realizes an easy and reliable connection can be more simply and reliably realized without depending on the shape of the socket element 2*i*. In addition, the operation for connecting both components and the operation for pushing the latching element 50 in for removing a short circuit of the short-circuiting piece can be performed by a series of operations at one time. The present invention is not limited to this construction.

In the connector 8, each of the pair of first legs 51 has two latching convex portions 55 formed in a projecting manner, the plug element 3 has four latch receiving convex portions 36 formed in a projecting manner, and on each of the latching convex portions 55 and each of the latch receiving convex portions 36, a contact surface 55*s* and a contacted surface 36*s* are formed, respectively, and at the first latching position, the contact surface 55*s* and the contacted surface 36*s* come into contact with each other, so that the latching element 50 is latched on the plug element 3. Accordingly, a device construction in which the latching element 50 is latched on the plug element 3 can be simply and reliably realized. The present invention is not limited to this construction.

In the connector 8, the contact surface 55*s* and the contacted surface 36*s* come into contact with each other in the inserting direction of the plug element 3 into the socket element 2*i* when the latching element 50 is at the first latching position. Therefore, in conjunction with the pushing of the latching element 50, the plug element 3 is reliably inserted into the socket element 2*i*. The present invention is not limited to this construction.

In the connector 8, the plug element 8 has a pair of terminal protectors 3*g* formed into cylindrical shapes surrounding the peripheries of the pair of female terminals 30, the short-circuiting element 4 has a pair of outer peripheral walls 4*g* formed into cylindrical shapes into which the pair of terminal protectors 3*g* are inserted and which surround the peripheries of the pair of pins 13, and on each of the pair of outer peripheral walls 4*g*, in order from the side of the plug element 3, an end portion 43 of the outer peripheral wall 4*g* and a latch receiving portion 41*a* are arranged along the inserting direction, and in the state where the plug element 3 is inserted into the socket element 2*i*, when the latching element 50 at the first latching position is pushed, by contact between each of the tip ends of the pair of first legs 51 and each of the end portions 43 of the pair of outer peripheral walls 4*g*, the pair of first legs 51 elastically bend to the radially outer sides of the outer peripheral walls 4*g*, and the latching convex portions 55 come apart from the positions of the latch receiving convex portions 36 and the contact surfaces 55*s* and the contacted surfaces 36*s* separate from each other, so that the latching at the first latching position is released, and as a result, the latching element 50 becomes movable to the second latching position. Accordingly, deformation of the pins 13 can be prevented, and the latching can be easily released by the simple device construction. In addition, the device construction in which the latching element 50 is latched on the plug element 3 can be simply and reliably realized. Further, in conjunction with the pushing of the latching element 50, the plug element 3 is reliably inserted into the socket element 2*i*. Then, the operation for connecting both components and the operation for pushing the latching element 50 in for removing a short circuit of the short-circuiting piece 4*m* can be more reliably performed by a series of operations at one time. The present invention is not limited to this construction.

In the connector 8, the latching element 50 has four restricting portions 54 formed so as to project from the pushed portion 5, and the respective restricting portions 54 restrict the movement of the plug element 3 so as to prevent the plug element 3 from coming off the socket element 2*i* when the latching element 50 is at the second latching position in the state where the plug element 3 is inserted into the socket element 2*i*. Accordingly, the plug element 3 can be prevented from coming off the socket element 2*i*. Therefore, by the latching element 50, separation between both components can be more reliably prevented. The present invention is not limited to this construction.

In the connector 8, on the socket element 2*i*, an engaging concave portion 15 is formed by recessing the socket element, and the plug element 3 has a pair of terminal protectors 3*g* formed into cylindrical shapes surrounding the peripheries of the pair of female terminals 30, and has two support portions 31*a* formed so as to project from the main body of the plug element 3, and on each of the support portion 31*a*, an engaging convex portion 31*b* which engages with the engaging concave portion 15 is formed, and the restricting portions 54 are inserted between the terminal protectors 3*g* and the support portions 31*a* to restrict the movement of the engaging convex portions 31*b* so as to come off the engaging concave portion 15 from the inner side. Therefore, separation between the plug element 3 and the socket element 2*i* is prevented by the simple construction. The present invention is not limited to this construction.

The electrical connection device 1 includes a socket element 2*i* supporting a pair of pins 13, and a connector 8, and the connector 8 is connected to the socket element 2*i*. According to this construction, an easy and reliable connection is realized without depending on the shape of the socket element 2*i*.

According to this technique, for example, by designing the latching element so that the projection angles of the two first legs from the pushed portion become the same between the state where the latching element is detached from the plug element and the state where the plug element is inserted into the socket element and the latching element is at the second latching position (the first legs do not bend at the second latching position), insertion can be completed without placing a burden on the first legs. Accordingly, the lifetime of the latching element can be lengthened.

An embodiment of the present invention is described above, however, the present invention is not limited to the above-described embodiment, and can be variously modified and implemented within the scope of the present invention.

For example, in the above-described embodiment, on the latching element, a pair of latch portions are formed, however, the number of latch portions may be one. In the above-described embodiment, on the first leg, two latch portions are arranged opposite to each other so as to project to each other, however, it is also allowed that the two latch portions are arranged so as to project to the radially outer sides of the socket. In this case, for the first legs, walls having latch receiving portions are provided at the radially outer sides.

In the above-described embodiment, a short circuit is removed by the second leg, however, it is only required that the short-circuiting piece moves to the non-short-circuit position when the latching element is at the second latching position, and for example, a device construction in which the short-circuiting piece is moved to the non-short-circuit position by the first legs is also allowed.

In the above-described embodiment, the two first legs project in a direction along the inserting direction when the latching element is at the first latching position, however, the present invention is not limited to this construction, and the first legs are allowed to project diagonally with respect to the inserting direction.

In the above-described embodiment, the plug element is inserted into the socket element. It is also allowed that the plug element is formed so as to envelope the socket element and the plug element and the socket element fit each other.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector connectable to a socket element supporting a pair of fitting elements, comprising:

a plug element which supports a pair of fitted elements to be electrically connected to the pair of fitting elements, and is inserted into the socket element and engages with the socket element;

a short-circuiting element which includes a short-circuiting piece for electrically short-circuiting the pair of fitting elements, and is attached to the socket element; and a latching element which is latched on the plug element at a first latching position and a second latching position, wherein the latching element is movable between the first latching position and the second latching position, and in a state where the plug element is inserted into the socket element, when the latching element is at the second latching position, the short-circuiting piece moves to the non-short-circuit position, either the latching element or the short-circuiting element has a latch portion formed in a projecting manner, and the other of these has a latch receiving portion formed so as to engage with the latch portion, and in the state where the plug element is inserted into the socket element, when the latching element is at the second latching position, the latch portion and the latch receiving portion engage with each other.

2. A connector connectable to a socket element supporting a pair of fitting elements, comprising:

a plug element which supports a pair of fitted elements to be electrically connected to the pair of fitting elements, and is inserted into the socket element and engages with the socket element;

a short-circuiting element which includes a short-circuiting piece for electrically short-circuiting the pair of fitting elements, and is attached to the socket element; and a latching element to be latched on the plug element at a first latching position and a second latching position, wherein the latching element is movable between the first latching position and the second latching position, and in the state where the plug element is inserted into the socket element, when the latching element is at the second latching position, the short-circuiting piece moves to a non-short-circuit position, the latching element has two latch portions formed in a projecting manner, the short-circuiting element has two latch receiving portions formed so as to engage with the two latch portions, and in the state where the plug element is inserted into the socket element, when the latching element is at the second latching position, the two latch portions and the two latch receiving portions engage with each other, and the latching element includes a plate-like pushed portion to be pushed, a pair of first legs formed so as to project from the pushed portion, and a second leg formed so as to project from the pushed portion, each of the pair of first legs has the latch portion, the second leg moves the short-circuiting piece to the non-short-circuit position by contact with the short-circuiting piece when it is at the second latching position in the state where the plug element is inserted into the socket element, and the pair of first legs are arranged so that the two latch portions are opposed to each other.

3. The connector according to claim 2, wherein on the pair of first legs, the two latch portions are formed so as to project to each other, the plug element has a pair of terminal protectors formed into cylindrical shapes surrounding the peripheries of the pair of fitted elements, the short-circuiting element has a pair of outer peripheral walls formed into cylindrical shapes into which the pair of terminal protectors are inserted and which surround the peripheries of the pair of fitting elements, and the two latch receiving portions are provided on the pair of outer peripheral walls.

4. The connector according to claim 2, wherein the short-circuiting element has a pair of walls provided along the inserting direction of the plug element into the socket element, and on each of the pair of walls, an end portion of the wall and the latch receiving portion are arranged along the inserting direction in order from the side of the plug element, and in the state where the plug element is inserted into the socket element, when the latching element at the first latching position is pushed, by contact between each of the pair of first legs and the end portions, the pair of first legs elastically bend to release latching at the first latching position, and the latching element becomes movable to the second latching position.

5. The connector according to claim 2 or 3, wherein the plug element has a pair of terminal protectors formed into cylindrical shapes surrounding the peripheries of the pair of fitted elements, the short-circuiting element has a pair of outer peripheral walls formed into cylindrical shapes into which the pair of terminal protectors are inserted and which surround the peripheries of the pair of fitting elements, and on each of the pair of outer peripheral walls, an end portion of the outer peripheral wall and the latch receiving portion are arranged along the inserting direction in order from the side of the plug element, and in the state where the plug element is inserted into the socket element, when the latching element at the first latching position is pushed, by contact between each of the tip ends of the pair of first legs and each of the end portions of the pair of outer peripheral walls, the pair of first legs elastically bend to the radially outer sides of the outer peripheral walls to release latching at the first latching position, and the latching element becomes movable to the second latching position.

6. The connector according to claim 4, wherein the pair of first legs project in a direction along the inserting direction of the plug element into the socket element when the latching element is at the first latching position in the state where the plug element is inserted into the socket element.

7. The connector according to any one of claims 2 through 4, wherein each of the pair of first legs has a latching convex portion formed in a projecting manner, the plug element has a latch receiving convex portion formed in a projecting manner, and on the latching convex portion and the latch receiving convex portion, a contact surface and a contacted surface are formed, and at the first latching position, the contact surface and the contacted surface come into contact with each other, so that the latching element is latched on the plug element.

8. The connector according to claim 7, wherein the contact surface and the contacted surface come into contact with each other in the inserting direction of the plug element into the socket element when the latching element is at the first latching position.

9. The connector according to claim 7, wherein the plug element has a pair of terminal protectors formed into cylindrical shapes surrounding the peripheries of the pair of fitted elements, the short-circuiting element has a pair of outer peripheral walls formed into cylindrical shapes into which the pair of terminal protectors are inserted and which surround the peripheries of the pair of fitting elements, and on each of the pair of outer peripheral walls, an end portion of the outer peripheral wall and the latch receiving portion are arranged along the inserting direction in order from the side of the plug element, and in the state where the plug element is inserted into the socket element, when the latching element at the first latching position is pushed, by contact between each of the tip ends of the pair of first legs and each of the end portions of the pair of outer peripheral walls, the pair of first legs elastically bend to the radially outer sides of the outer peripheral walls, and the latching convex portion comes apart from the position of the latch receiving convex portion and the contact surface and the contacted surface are separated from each other, so that the latching at the first latching position is released, and as a result, the latching element becomes movable to the second latching position.

10. The connector according to any one of claims 2 through 4, wherein the latching element has a restricting portion formed so as to project from the pushed portion, and the restricting portion restricts the movement of the plug element so as to prevent the plug element from coming off the socket element when the latching element is at the second latching position in the state where the plug element is inserted into the socket element.

11. The connector according to claim 10, wherein in the socket element, an engaging concave portion is formed by recessing the socket element, the plug element has a pair of terminal protectors formed into cylindrical shapes surrounding the peripheries of the pair of fitted elements and has a support portion formed so as to project from the main body of the plug element, an engaging convex portion which engages with the engaging concave portion is formed on the support portion, and the restricting portion is inserted between the terminal protectors and the support portion and restricts the movement of the engaging convex portion so as to come off the engaging concave portion from the inner side.

12. An electrical connection device comprising:

a socket element which supports a pair of fitting elements, and;

the connector according to any one of claims 1 through 4, wherein the connector is connected to the socket element.

* * * * *